United States Patent [19]

Weintraub

[11] Patent Number: 4,899,551

[45] Date of Patent: Feb. 13, 1990

[54] AIR CONDITIONING SYSTEM, INCLUDING A MEANS AND METHOD FOR CONTROLLING TEMPERATURE, HUMIDITY AND AIR VELOCITY

[76] Inventor: Morton Weintraub, P.O. Box 229, Brooklyn, N.Y. 11230

[21] Appl. No.: 114,541

[22] Filed: Oct. 29, 1987

Related U.S. Application Data

[63] Continuation-in-part of Ser. No. 633,360, Jul. 23, 1984, abandoned.

[51] Int. Cl.[4] ..... F25B 49/00; F25D 17/00

[52] U.S. Cl. ..... 62/176.6; 62/205; 62/180; 236/44 C

[58] Field of Search ..... 62/204, 205, 210, 211, 62/222, 223, 224, 510, 149, 174, 215, 226, 229, 230, 228.1, 228.4, 228.5, 176.1, 176.3, 176.6, 180; 236/49, 44 R, 44 A, 44 C; 165/16, 20

[56] References Cited

U.S. PATENT DOCUMENTS

| | | | |
|---|---|---|---|
| 2,228,996 | 1/1941 | McGrath | 62/215 |
| 3,499,297 | 3/1970 | Ruff et al. | 62/228.4 X |
| 4,189,094 | 2/1980 | Robinson | 236/49 X |
| 4,217,541 | 8/1980 | Weintraub et al. | 323/347 |
| 4,257,238 | 3/1981 | Kountz et al. | 62/176.6 X |
| 4,270,361 | 6/1981 | LaBarge | 62/211 X |
| 4,407,185 | 10/1983 | Haines et al. | 236/49 X |
| 4,461,156 | 7/1984 | Weintraub | 62/149 |

FOREIGN PATENT DOCUMENTS

| | | | |
|---|---|---|---|
| 0082624 | 7/1981 | Japan | 62/239 |

*Primary Examiner*—Harry B. Tanner

[57] ABSTRACT

The present application relates to a means and method for simultaneously and independently controlling a pressure of a medium including refrigerant pressure of one and a plurality of output devices and for controlling a current input to one and a plurality of output devices in a relationship in accordance with a point temperature setting, a point humidity setting, and a point air velocity setting; enabling the circuit connecting one and a plurality of output devices to be broken upon a predetermined current deviation beyond the current controlled in a relationship to the point temperature, humidity, and air velocity of their respective settings; enabling the automatic resetting of the circuit to the power supply when the predetermined current deviation had been alleviated; enabling one or more output devices including a compressor of a refrigeration circuit to be maintained running after the temperature of a space becomes equal to the point temperature of a temperature setting and after the humidity of a space becomes equal to a point of a humidity setting; enabling a refrigeration circuit normally controlling temperature of a space to control humidity of a space to maintain a point humidity of a humidity setting without a drying coil and without modification of the refrigeration circuit.

37 Claims, 11 Drawing Sheets

COOLING

HEATING

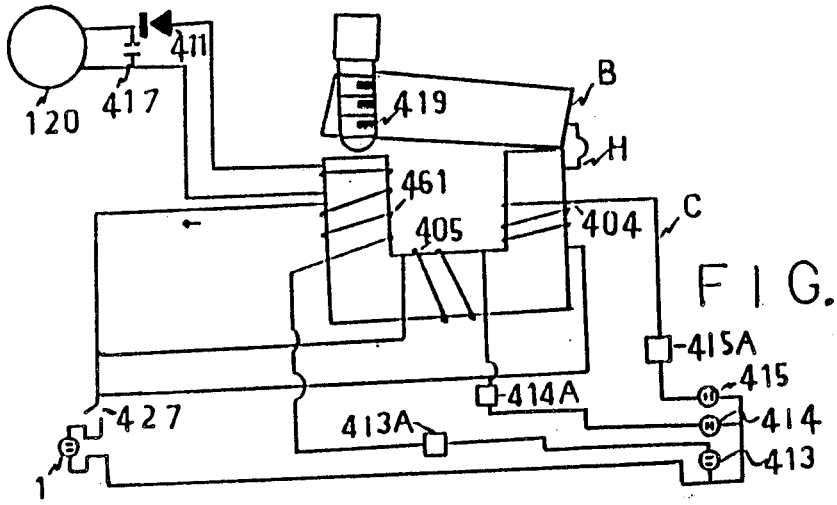
FIG. 8
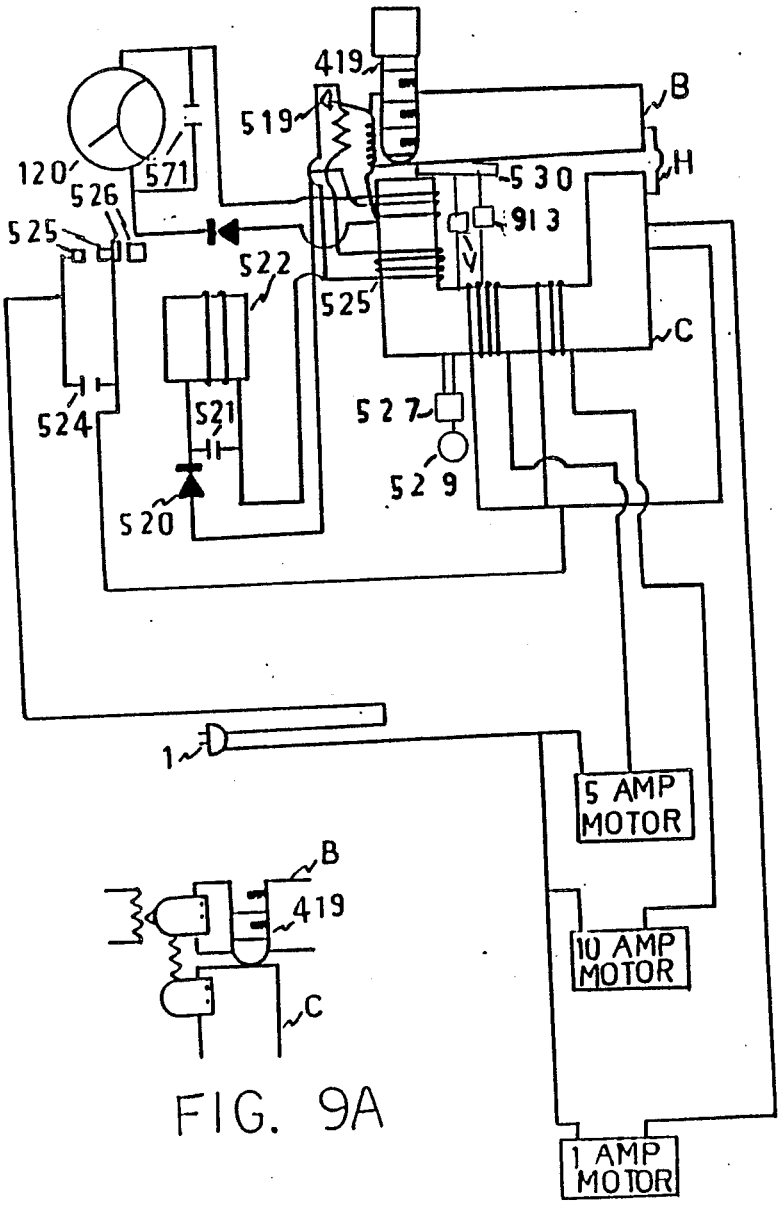
FIG. 9
FIG. 9A

AIR CONDITIONING SYSTEM, INCLUDING A MEANS AND METHOD FOR CONTROLLING TEMPERATURE, HUMIDITY AND AIR VELOCITY

This is a continuation in part of application Ser. No. 06/633,360 filed Nov. 7/23/84 abandoned.

A first objective of the invention is to provide a means and method of controlling a variable chamber thereby controlling refrigerant pressure of a refrigeration circuit and one or more output devices in a relationship to a point temperature of temperature setting and in a relationship in accordance with a deviation of a temperature of a space controlled by the refrigeration circuit from a point temperature of a temperature setting for the space.

Another objective of the invention is to provide a means and method of controlling a variable chamber thereby controlling refrigerant pressure of a refrigeration circuit and one or more output devices requiring identical and divergent current input for operation in a relationship to a point humidity of humidity setting and in a relationship in accordance with a deviation of a humidity of a space controlled by the refrigeration circuit from a point humidity of a humidity setting for the space.

Another objective of the invention is to provide a means and method of controlling a current input to a compressor of a refrigeration circuit and one or more output devices requiring identical and divergent current input for operation in a relationship to a point temperature of temperature setting and in a relationship in accordance with a deviation of a temperature of a space controlled by the refrigeration circuit and one or more output devices from a point temperature of a temperature setting for the space.

Another objective of the invention is to provide a means and method of controlling a current input to a compressor of a refrigeration circuit and one or more output devices requiring identical and divergent current for operation in a relationship to a point humidity of humidity setting and in a relationship in accordance with a deviation of a humidity of a space controlled by the refrigeration circuit from a point humidity of a humidity setting for the space.

Another objective of the invention is to provide a means and method of controlling a current input to one or more output devices requiring identical and divergent current for operation in a relationship to a point air velocity of air velocity setting and in a relationship in accordance with a deviation of a air velocity of a space controlled by the refrigeration circuit from a point air velocity of a air velocity setting for the space.

Another objective of the invention is to enable the circuit connecting the compressor of one or more refrigeration circuits and one or more output devices requiring identical and divergent current input for operation to be broken upon a prerdetermined current increase beyond the current being controlled in a relationship to the point temperature of a temperature setting and enabling the automatic resetting to the power supply when the predetermined current increase had been allevated.

Another objective of the invention is to enable the circuit connecting the compressor of one or more refrigeration circuits and one or more output devices requiring identical and divergent current input for operation to be broken upon a predetermined current increase beyond the current being controlled in a relationship to the point humidity of a humidity setting and enabling the automatic resetting to the power supply when the predetermined current increase had been allevated.

Another objective of the invention is to enable the circuit connecting one or more output devices requiring identical and divergent current input for operation to be broken upon a prerdetermined current increase beyond the current being controlled in a relationship to the point air velocity of an air velocity setting and enabling the automatic resetting to the power supply when the predetermined current increase had been allevated.

Another objective of the invention is to enable the compressor of one or more refrigeration circuits and one or more output devices to be maintaintained running after the temperature of a space conditioned by the compressor and one or more output devices becomes equal to the temperature of a temperature setting.

Another objective of the invention is to enable the compressor of one or more refrigeration circuits and one or more output devices to be maintained running after the humidity of a space conditioned by the compressor and one or more output devices becomes equal to the humidity of a humidity setting.

Another objective of the invention is to enable one or more output devices to be maintained running after the air velocity of a space conditioned by the compressor and one or more output devices becomes equal to the air velocity of a air velocity setting.

Other objectives will become apparant during the course of the disclosure.

BRIEF DESCRIPTION OF THE DRAWINGS

FIG. 8 is a drawing of a current control device which optionally may be connected and operating in FIG. 6.

FIG. 9 is a drawing of circuit breaking means and controlling current overload to the compressor motor. FIG. 9 illustrates also a current control device providing manual control of current in a relationship in accordance a temperature, humidity, and air velocity setting by 419, such that the gap between bar B and core C is adjusted in a relationship to the setting on 419.

FIG. 9A illustrates the operation of the variable resister when bar B is moved.

DETAILED DESCRIPTION OF THE INVENTION

Figure 25:
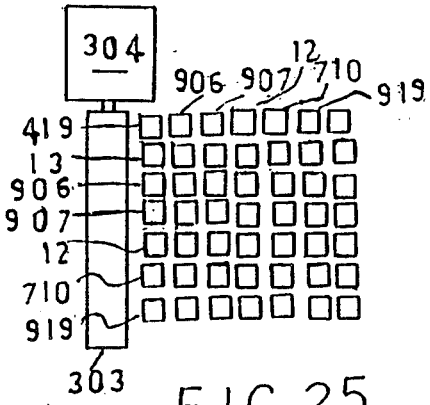
FIG. 25 shows the operation of one or more output devices of FIG. 1–24 may be connected or disconnected to another one or more of these devices (via a gearing of a plurality of 419s e.g. as shown) thereby providing a means for controlling the output of one or more of the connected output devices in a relationship in accordance with the output of another one or more output devices while at the same time all are governed by gear 303.

[Note: All references throughout the disclosure to gears 906 and 907 functioning to illustrate different gears of different sizes should be viewed in an operative relationship as shown in FIG. 25.]

Among the underlying principles of operation of the innovative apparatus is as follows: When operating in an air conditioning unit, the controls will permit the unit to make use of a fraction of its peak power e.g. 7,000 B.T.U. in relation to 10,000 B.T.U. at peak output. The unit remains continuously "on" while maintaining the desired the desired temperature (enabling a window to be left open as the unit will not shut down upon a temperature deviation). The object of the innovative method is to reduce the pressure upon the compressor by drawing off some of the freon gas (or other cooling means) hence providing less cooling thereby providing less electrical surge.

There is a direct relationship between the B.T.U. output of an air conditioning unit and the unit's amperage, PSI (pounds per square inch) and temperature degrees obtained for a given room size. For illustration, the table below will show the operating relationship of

| AMPS | PSI | BTU | DEGREES |
|---|---|---|---|
| 15 | 25 | 10,000 | 40 |
| 12 | 20 | 9,000 | 50 |
| 9 | 15 | 8,000 | 60 |
| 6 | 10 | 7,000 | 70 |

We may therefore say that the object of the present method of temperature control is to control temperature by adding or subtracting pressure.

Figure 1:
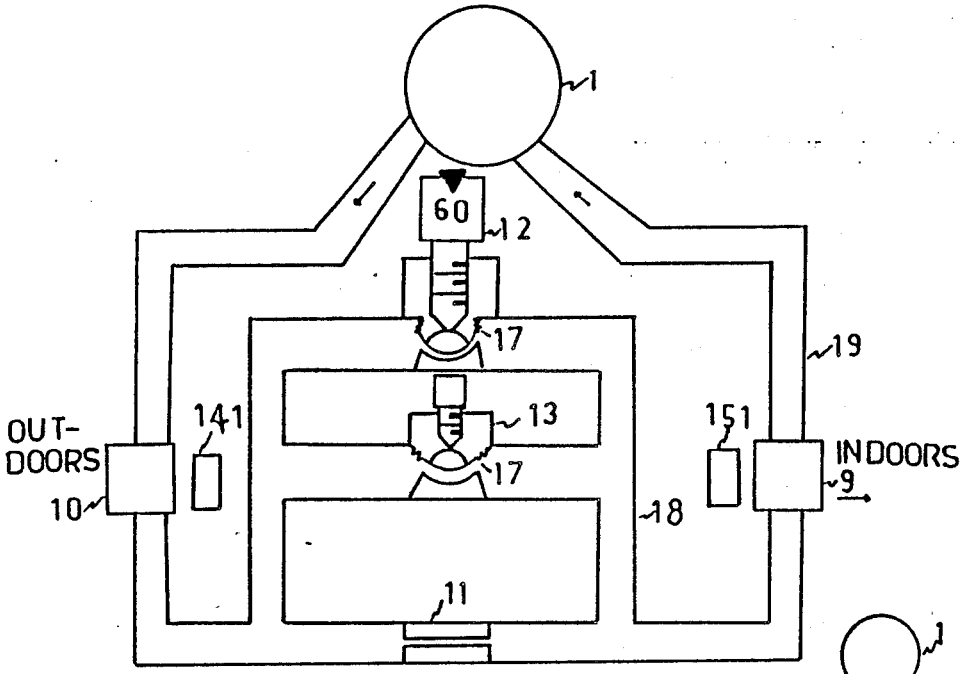
FIG. 1 is a drawing describing the operations of a manually operated thermostat operating in an air conditioning unit.

FIG. 1 is a drawing of a manually operated thermostat. Thermostat is situated between the evaporator and the condenser so as to allow more or less gat to pass. In operation the user sets the temperature by manually turning 12 to the desired degree level. This action causes a contraction or expansion of expandable metal strip 17, allowing more or less gas to pass from the compressor. In an ordinary air conditioner, a compressor compresses gas which gets hot as a result of compression. The gas is then cooled via a cooling radiator and condensed via a condenser.

In the operation of the faucet thermostat, more or less gas is allowed to the condenser. Hence when the faucet is fully opened the condenser has little or no effect on the gas because the pressure on the gas is reduced. As the faucet (or piston, described in FIGS. 1A, 3) closes the gap in pipe or chamber 18, pressure on the gas is built up proportionately thereby. Cooling likewise results in a relationship to the opening and closing of the faucet.

The amount of cooling of a given room area in relationship to a given air conditioner may be calibrated to that a given opening of the faucet will result in a 70 degree temperature and whereas a given amount of turns of faucet 12 would normally result in the addition or subtraction of a degree based upon a given temperature outside.

For example, a 10,000 BTU system might cool a 1000 cubic foot area at full cooling capacity i.e. with the gap of the faucet fully closed, keeping the room temperature at a constant 50 degrees when the temperature outside is 90 degrees. Setting the dial of faucet thermostat 12 determines the temperature in the room. Not that by adding additional faucets we may have a finer control of larger units when they are used to cool a smaller area. Hence when a 10,000 B.T.U. air conditioning unit at full capacity is place in a room of 500 cubic feet a setting of 50 degrees may be enabled by reducing the unit's cooling capacity by opening the gap of the additional faucets. The use of additional faucets would enable finer control of temperature in relationship to the outside temperature. For example, when the outside temperature is 80 degrees and the user desires 70 degrees in side, one may set one faucet thermostat to 80 degrees and another to 70 degrees. Both faucets would be calibrated to provide the desired temperature. In the connection, screw 13 serves as a second faucet for finger adjustment on a single unit. The compressor 1, evaporator 9, condenser 10, and expansion valve 11 are shown in FIG. 1. The fan of the condenser 141 blows outdoor air over the condenser coils and evaporator fan 151 and coils 19 basically complete the refrigeration system. Note that one or more faucet or piston type thermostats may be used on the same unit in conjunction with each other or separately.

Figure 1A:
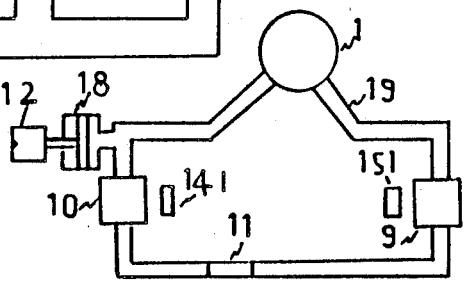
FIG. 1A is a "piston" type thermostat operating in an air conditioning unit.

Note that a stopper may be used instead of expandable metal strip 17 in FIG. 1 whereby the piston shown in FIG. 1A forces a stopper which serves to stop the air flow in duct 19 against spring means or open same depending upon which way 12 is turned, causing thereby a calibrated temperature reading upon 12 as shown in FIG. 1. Such a thermostat may be labled a piston type thermostat. Another variation the piston type thermostat is described in FIGS. 3, 1A.

FIG. 1A is similar in operation the that of FIG. 1. However, FIG. 1A describes the operations of the piston type thermostat. The freon gas is compressed by compressor 1 and passes coils or tubes whereby more or less gas may circulate to the compressor 1 as a result of the action of the piston and it chamber 18 when more gas enters the chamber a higher temperature will show on 12 and also on the room thermometer; and vice versa with less gas drawn by piston and it chamber 18.

Figures 3, 3A:
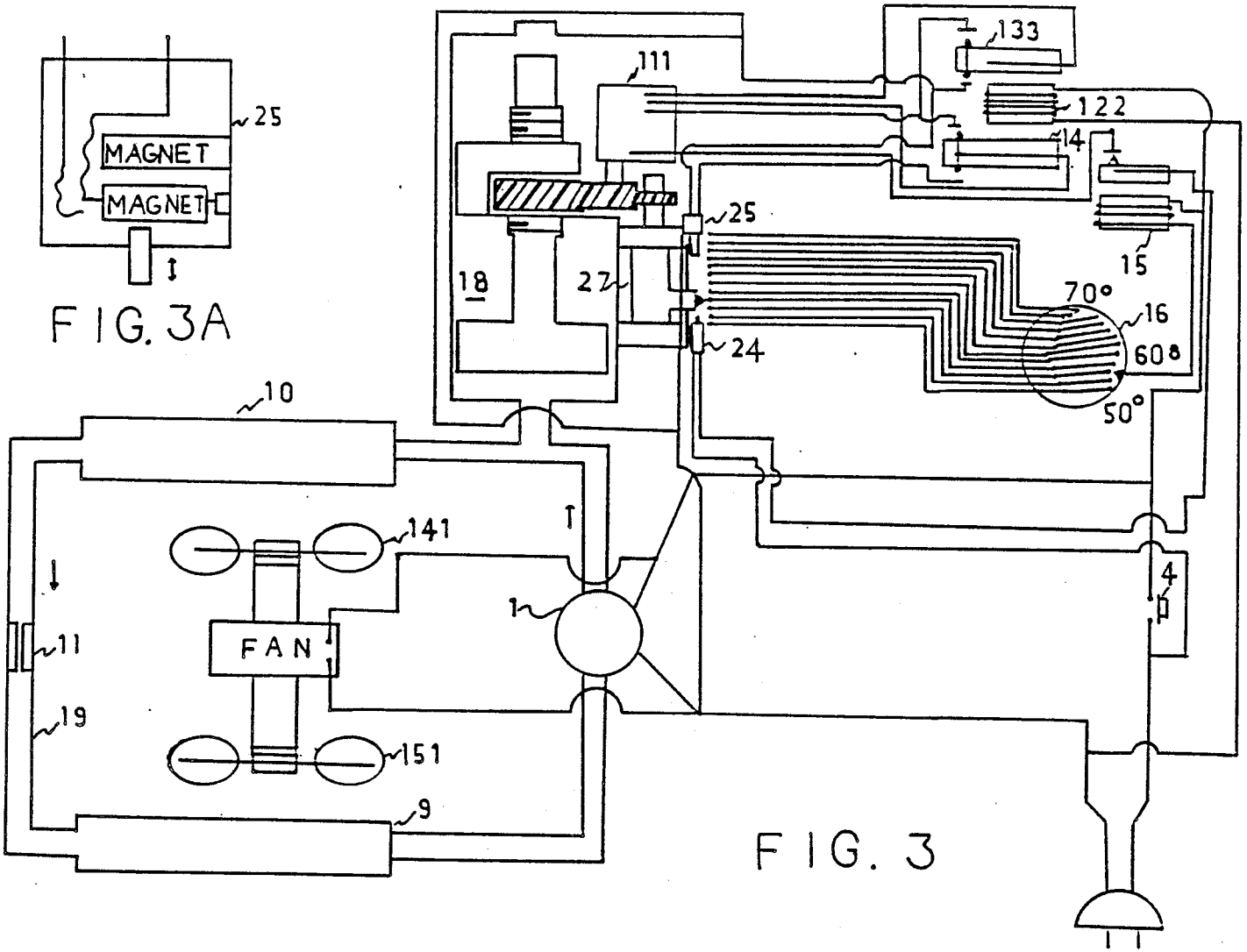
FIG. 3 is another type of motorized control of FIG. 1A.
FIG. 3A illustrates the action of switch 25 and switch 24.

Note that both the piston and faucet types of thermostats may operate in conjunction, whereby, a piston type thermostat may be installed in FIG. 1 between the condenser 10 and the compressor 1 attached to pipe 19 as part of the system. Those of the faucet thermostat may be extended to be operated automatically via a motorized control of the gap opening. FIG. 3 is a drawing of the operation of a motorized piston (a faucet type shown in FIG. 1 may be used as well) thermostat. The plug is plugged in an AC outlet and switch 4 puts the air conditioning unit on. The "on" position causes relay 122 to become energized thereby pulling inwards contact 133 and 14 against a spring action keeping same apart, thereby causing a closkwise (downwards) spin on piston 18. When contacts 133 and 14 are released a counter clockwise movement (upwards spin) results.

The user sets thermostat 16 manually even at a remote location for the air conditioning unit, whereby the thermostat is hooked to the piston controls. The wires on thermostat 16 represent degree setting. Each wire represents two degrees. Time delay switches 24 and 25 operate in a manner whereby when block 27 depresses switches 24 and 25 they will turn off motor 111 after a time delay. When piston 18 is fully up, activating switch 4 causes a downward movement of piston 18 thus causing a corresponding downward movement of block 27 until its pointer comes into contact with the same wire setting, manually set on thermostat 16. The circuit being completed via relay 15 will stop motor 111 halting piston 18. Note that the compressor and fan still continue in operation. When "on" and "off" switch 4 is switched to the off position piston 18 will move upwards to the top of its chamber releasing the pressure from the unit, as activation of the reverse winding of motor 111 is caused thereby. When bock 27 hits switch 25 it will cause a shut down of the unit, while activating switch 24 will reverse the motor thereby bringing piston 18 back up.

FIG. 3A illustrates the action of switch 25 (and switch 24).

Note that the arms of relays 15 and 122 are kept open by spring action until they are activated by the relay. Note that there are numerous other ways in which motor 111 maybe controlled as a result of a manual temperature setting. For example, a higher manual setting may cause motor 111 to spin whereby it tightens or loosens a rope. A higher manual temperature setting will result in a spin on motor 111 resulting in a tightening of the rope causing piston 18 to go upwards.

Figure 2:
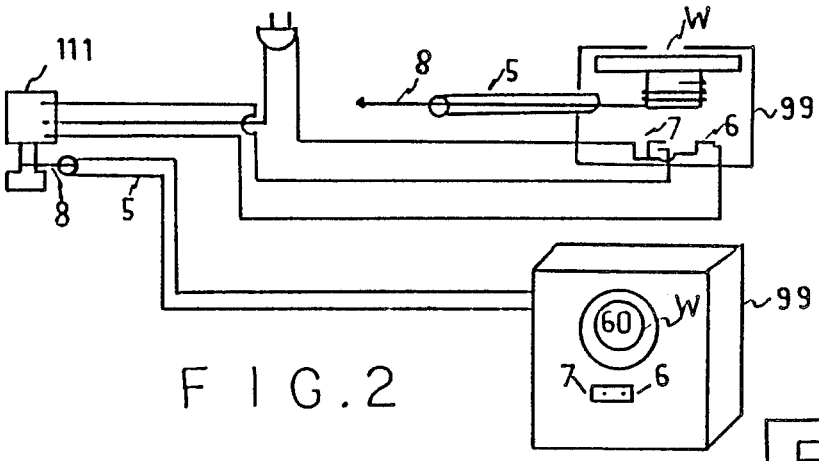
FIG. 2 is a drawing describing the operation of a motorized thermostat control of FIGS. 1, 1A.
Figure 2A:
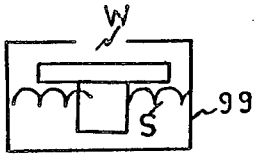
FIG. 2A describes the spring action against the rope of the meter and attached to the meter wall.

FIG. 2 is a drawing of this kind of thermostat. Rope 8 in its encasement 5 operates similarly to the operation of the hand brake of a bicycle. Temperature is set on thermostat 99 by manually depressing bell type switch 6 (for a higher setting at window W, causing motor 111 to spin piston 18 (see FIG. 3) upwards and switch 7 (for lower setting causing a reverse action on motor 111). Note that a spring S (see FIG. 2A) maintains a pulling action against the rope 8 keeping the degrees shown at window W at 60 unless electronically put to a higher level as a result of activating switch 6 or to a lower level by activating switch 7.

Motor 111 is geared to piston 18 (see FIG. 3) and thermostat 99 is so calibrated so as to provide the cooling from the air conditioning unit to the degree setting upon the thermostat.

Figure 6:
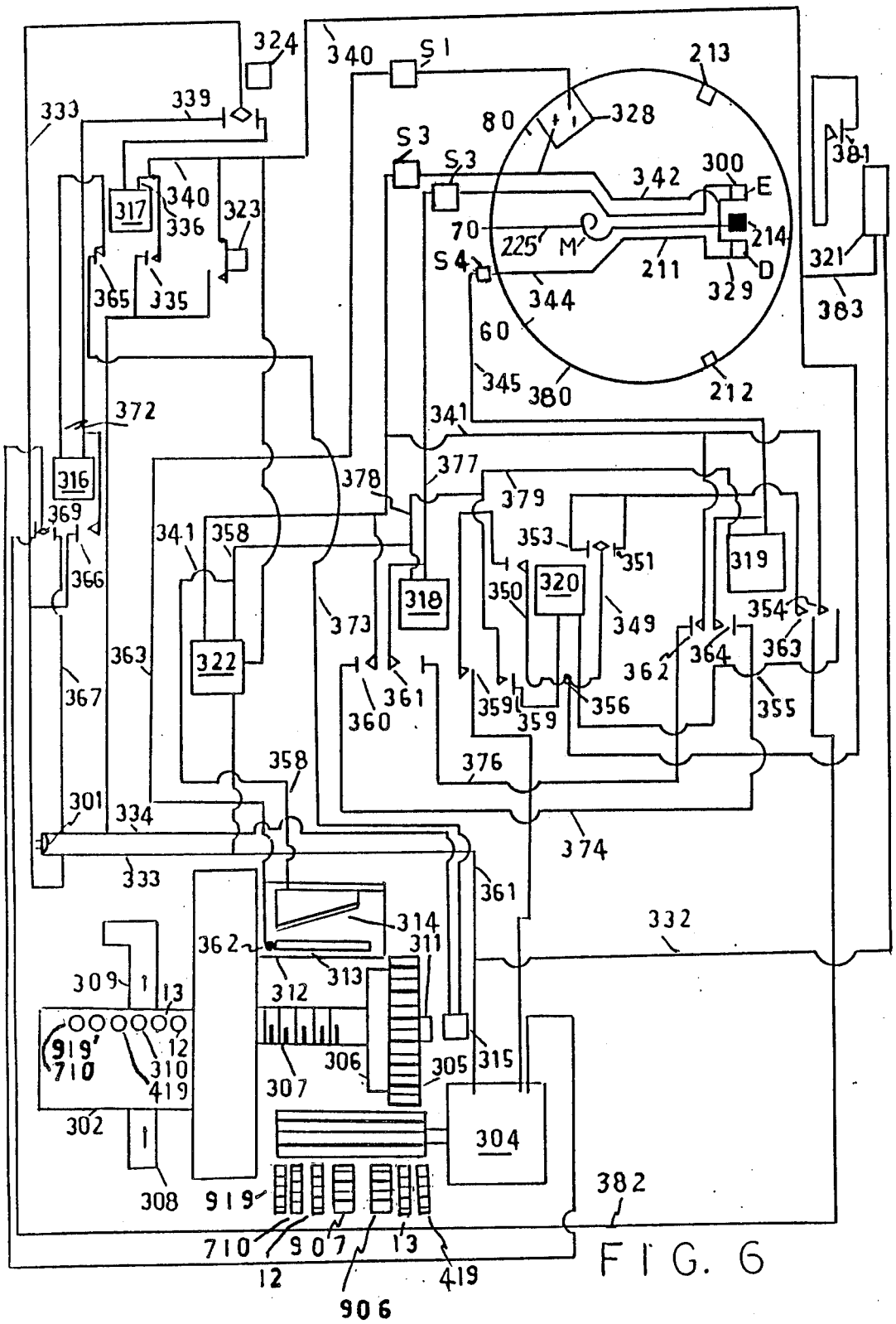
FIG. 6 is a drawing of the circuitry of FIG. 5.

FIG. 3 is a drawing of the operation of a motorized control for FIGS. 1, 1A and is included in FIG. 6 at the option of the user by controlling 310 (the functional equivalent of 12 having a gear thereon (not shown in FIG. 1, 1A). Note that while FIG. 3 illustrates the drawing of the operation of the piston as shown in FIG. 1A piston 18 of FIG. 3 may be substituted by expanding and contracting means 17 and providing the operation of mixing high and low pressure refrigerant as shown in FIG. 1.

The plug in FIG. 3 is plugged into an AC outlet and switch 4 puts the unit on. The "on" position causes relay 122 to pull contacts 133 and 14 against spring action (not shown) causing thereby a downwards spin on the piston mounted in chamber 18. When these contacts are released an upward movement of the piston results.

The user may set a selected temperature on meter 16 which may be at a remote location. The temperature setting means thereby is connected to wires as shown. Time delay switch 24 operates whereby when block 27 depresses the switch it acts to turn off motor 111 after a time delay. Switch 24 when activated causes piston to move upwards to switch 25 and activating same. When the selected temperature has been set, contact of block 27 adjusting the cavity of chamber 18 by activating relay 15 causes motor 111 to stop. When switch 4 is in the "off" position motor 111 brings the Piston all the way up until block 27 engages switch 25. Chamber 18 is identical to that in FIG. 1 and is calibrated to provide the operations of Table 1. FIG. 3*a* illustrates the action of switches 24, 25 in FIG. 3 the arms of relays 15, 122 are kept open by a spring (not shown) until the relays are activated forcing their closing.

FIG. 2 is a drawing wherein motor 111 controls the size of the cavity and/or orifice of chamber 18 as disclosed in the disclosure of FIGS. 1, 1A or to 310, the functional equivalent of 12 in FIG. 6, such that 12 or 310 have gearing means (not shown) and that means are geared to motor 111 of FIG. 2 and controlled by the apparatus of FIG. 2. A higher temperature setting set manually by manually depressing switch 6, causes motor 111 to control 12 in FIGS. 1, 1A or 310 in FIG. 6 thereby increasing the pressure requirement of the refrigeration circuit thereby lowering the temperature of the area being conditioned, whereas depressing switch 7 achieves an opposite effect. Spring S (see FIG. 2A) maintains a pulling action on rope 8. Rope 8 behind encased in 5 as shown. When motor 111 of FIG. 2 controls 310 of FIG. 6 whereby the operation is as disclosed of FIG. 2, it provides the means to manually increase or decrease the actual temperature of an area being conditioned, such that the manual control is effected with or without cooperation of the automatic operations disclosed in FIG. 6.

Figure 4:
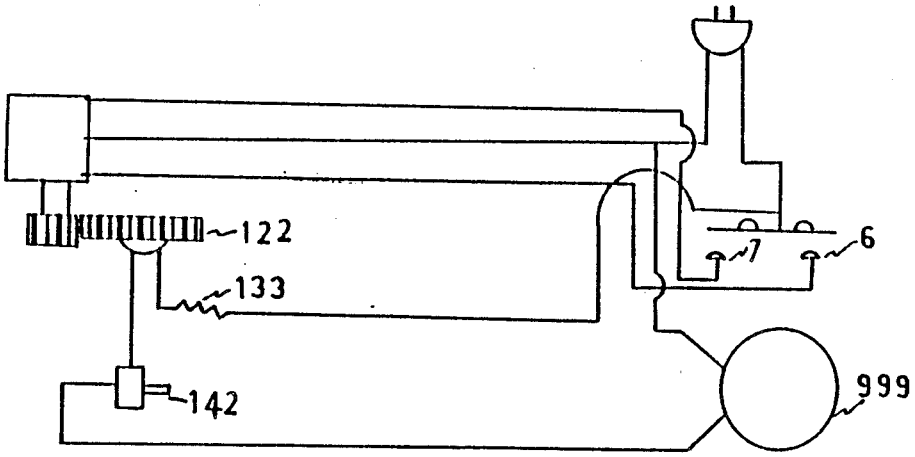
FIG. 4 is a drawing describing the operations of another electronic motorized thermostat control of FIGS. 1, 1A.

FIG. 4 represents a thermostat also operated electronically. AC meter 999 is calibrated in temperature degrees. Bell type switches 6 and 7 described previously are connected to the forward and reverse winding of motor 111. Meter 999 is connected to resistor 133 which serves to knock out current from meter 999 so that it may be set by rheostat 122. Rheostat 122 opens or shuts the current to meter 999, hence gauging the needle reading on meter 999, to a desired degree setting. Adjusting rheostat 122 serves to manually adjust meter 999 to the desired degree setting.

In operation, when button 6 is depressed, this causes a forward spin on motor 111 turning rheostat 122 into a position whereby there is a desired temperature reading on meter 999. Motor 111 will stop when button 6 is released. Motor 111 will stop when button 6 is released. Motor 111 controls the level of piston 18 and 17 in FIG. 1A whereby the gear of motor 111 is geared to rheostat 122 and to the piston in FIG. 1A via gear 12.

Figure 5:
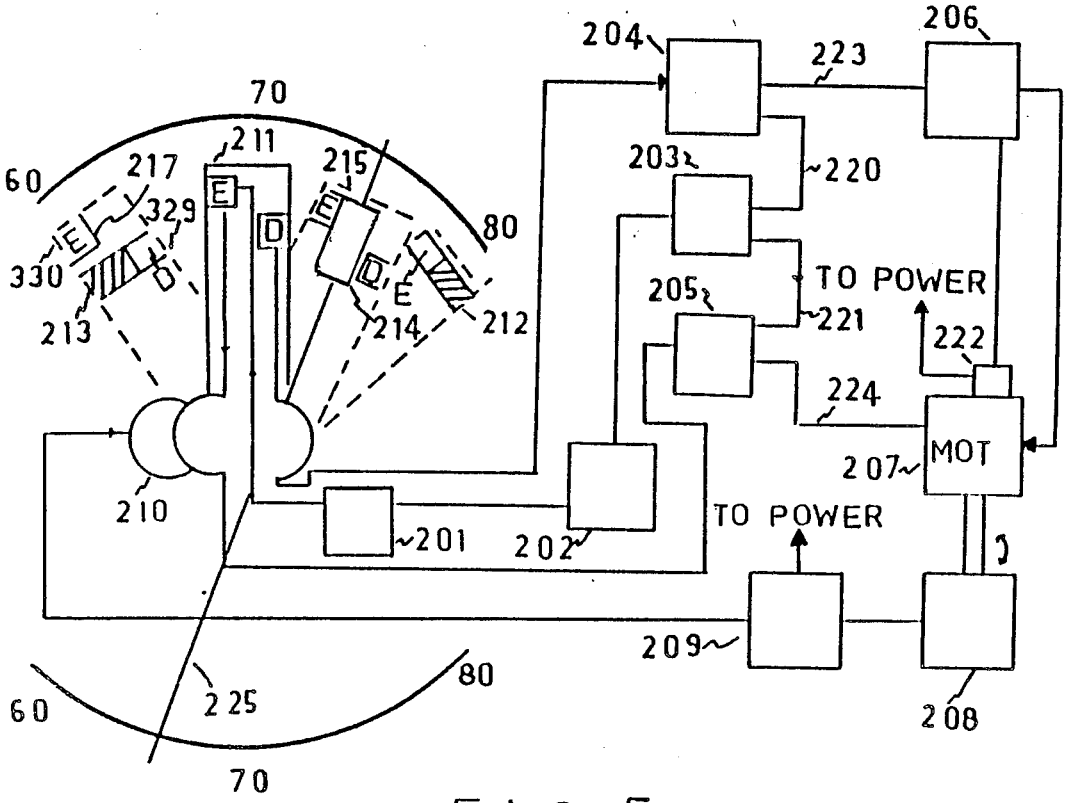
FIG. 5 is a drawing in flock form of a motorized automatic adjusting thermostat control, adjusting the unit's output continuously to maintain the desired set temperature.

FIG. 5 is a block diagram describing the automatic thermostat operations controlling the movement of the faucet or piston described previously.

Power supply 201 when the "on" relay 202 is energized will feed current to relay 203. Current is then passed to wire 220 and 221. Relay 204 controls the up drive coil of motor 207 driving up the piston 208 (see 305 in FIG. 6). Relay 205 controls the down coil of motor 207 driving piston 18 downwards, with current stemming from wire 221. When relay 203 is energized, it causes current to flow through wire 220 only, not through wire 221. Relay 206 is the "off" relay causing motor 207 to cause an upward spin on the piston represented in block 208 and then to close the power by closing switch 222 and at the same time disconnect current from wire 223.

When motor 207 turns clockwise it causes piston 208 to close while turning counter clockwise it will open piston (or faucet see FIG. 1) 208. When piston 208 goes downward it increases current flow via volume control 209, while reducing current flow when piston 208 goes upward. These increases or decreases in current flow are reflected by meter 210, and causing scanner 211 to move to the right with an increase in current; to to the left with a decrease in current.

With no current to the unit scanner 211 will be at position 217. Scanner 211 starts to scan toward the right with an increase in current, at the same time the down drive of motor 207 is activated. When the scanner magnetic switch D is over permanent magnet 214 it will energize the up relay 204, disconnecting current from wire 223. At this time magnetic switch E is out of the magnetic influence of permanent magnet 214, thereby not energizing the down relay 205.

The movement of scanner 211 continues to the right until reaching positions 215 which is the "on target" position, as the scanner 211 will stop moving thereby stopping motor 207, piston 208, volume control 209, and meter 210. This comes about when magnetic switches D and E are equally under the influence of permanent magnet 214, whereby 204 and 205 are activated to cut current from wire 223, 224.

Temperature is measured by pointer of permanent magnet 214 as it is connected to an expanding and contracting spring (shown in FIG. 6) which expands and contracts as a reaction to temperature. By setting pointer 225 to any temperature desired, this will control the position of permanent magnet 214 as it is connected to pointer 225. Pointer 225 in our example in on 66 degrees while permanent magnet 214 is between 74 and 75 degrees. As explained previously, piston 208 works in an air conditioner by increasing the amount of cooling via the down drive and reducing cooling via the up drive. When the temperature is high as in our example, 74 degrees, scanner 211 will cause piston 208 to close and scanner 211 will move until over permanent magnet 214 whereby it is on target closing magnetic switches stopping all movement. Movement starts again with a temperature change as permanent magnet 214 will move away from its present position. Should there be a one half degree change to 731/2 magnetic switch D will be out of the influence of permanent magnet 214 thus causing relay 204 to become deactivated causing the activation of the up drive of 207, causing less current to volume control 209 and causing meter 210 to move scanner 211 to the left until on target over permanent magnet 214 at 731/2 degrees. This cause and effect relationship will be repeated should the temperature of back to 741/2 degrees. Similarly, when the temperature goes up to 751/2 degrees thereby resulting in the movement of permanent magnet 214 away from magnetic switch E while magnetic switch D is still under the magnetic influence of permanent magnet 214, it will cause a deactivation of relay 205 whereby wire 221 is connected to wire 224 passing current to the down drive of motor 207 closing piston 208, causing scanner 211 to move to the right via the action of meter 210 until on target.

Relay 203 is for free scan. If for any reason scanner 211 was in position near 217, such as because of interruption of electricity, relay 203 would automatically activate the up drive of motor 207 causing a movement of scanner 211 to the left until magnetic switch D comes into influence of permanent magnet 213 to activate magnetic switch D and activating the down drive of motor 207, causing a movement to the right of scanner 211 until over the "on target" position whereby activating switches D and E. Similarly, the operation of permanent magnet 212 would be activated, reverses the movement of the scanner.

In the example given previously, there is a relationship between the 1000 cubic ft. room and a 20000 B.T.U. air conditioner operating at full capacity with piston 208 all the way down, or fully close. At 90 degree temperature, if the air conditioner provides us with 60 degrees inside the room at full capacity operation, then to provide us with 70 degrees inside the room, piston 208 would close down about half way in effect giving us now a 10000 B.T.U. air conditioner; a 5000 B.T.U. air conditioner for 75 degrees and so on.

In order to calibrate the thermostat, this system would be placed in a room with 70 degrees temperature whereby the pointer over permanent magnet 214 points to a corresponding temperature reading of 70 degrees and setting at same time pointer 22 to 70 degrees. Hence, there are now two ways of controlling the amount of cooling (1) via the temperature (magnet 213); (2) via Pointer 225.

How, with 90 degrees at start up of the unit magnet 214 would be over to the 80 degree mark, hence causing the unit to operate at full capacity of 20000 B.T.U. decreasing the B.T.U. output with lowering temperatures until 70 degrees set by pointer 225 is reached whereby the unit will be working at 10000 B.T.U. output or at half capacity, as illustrated above. Hence, whenever pointer 225 is in a straight line with pointer of permanent magnet 214 as shown in FIG. 5 the air conditioner will stabilize at that setting. Should pointer 225 be now set at 75, permanent magnet will automatically move towards 80 closing down piston 208. How much piston 208 will close depends upon the weather. Suppose the temperature is 72 degrees in the room as arm 225 is set at 70 then the pointer of the permanent magnet would set itself at 72 degrees in the room as arm 225 is set at 70 then the pointer of the permanent magnet would set itself at 72 degrees and stop. If pointer 225 is set at 75, then the pointer of 214 will stop at 67 so that we have a straight line up, and stabilized operation.

If the temperature increases (past 90) or the door of the room is opened, this will automatically cause the unit to operate on a greater output as permanent magnet 214 will move toward 80. If the temperature decreases the permanent magnet will move toward 60 reducing the output of the unit in B.T.U. The same is the reaction when a large capacity unit would be placed into a small room or vice versa. The same applies for a refrigeration unit. When the door is kept closed the temperature therein is kept as set. When the door is opened cooling would automatically increase. FIG. 6 illustrates the circuitry of FIG. 5.

There are two power supplies: (1) 110 volts via plug 301; (2) a DC power supply 322 providing power to all DC relays and components.

Motor 304 will close piston 305 (enclosed in a chamber as shown in FIG. 3, not shown here) or open same. Screw 310 (see 11 in FIG. 1) is used for finer adjustment of the air flow as explained previously. Pipe 308 is for outgoing gas. When motor 304 rotates it rotates gear 303 and 305 causing screw 307 to move up or down.

Volume control 312 operates in a manner whereby a liquid or gas conductor such as water or neon increases or decreases current flow coming from wire 358 connected to plate 314 passing current to the liquid or gas conductor to magnetic bar 313 placed whereby they will repell each other, maintaining the same distance away from each other. When screw 307 goes down an increase of current will result flowing from permanent magnet 313 to plate 314 with movement closer to 314.

Relay 317 receives current from wire 333 via switch 324 which is normally in the up position. When switch 323 is presseo momentarily it will pass AC from wire 334 to wire 340 and to wire 336 energizing relay 317. Switch 335 will keep relay 317 energized constantly unless electricity is momentarily interrupted. Switch 335 will also pass AC to the unit via wire 340. Switch 365 disconnects "off" relay 316.

To shut the unit off, button 324 is pressed momentarily as it disconnects relay 317 (the "on" relay) at the same time connecting "off" relay 316. When relay 316 is energized it keeps itself energized via switch 366.

Alternating current to relay 316 stems from wire 333 which passes current to wire 339.

AC stems from wire 334 passing to switch 315 to wire 373 to switch 365 and to wire 372 energizing relays 316. Switch 369 has two functions: (1) when the unit is on (meaning that relay 316 is off) then current from up relay 319 will pass to wire 368 and switch 369 to the up drive of the motor; (2) when the unit is shut off (meaning that relay 316 is now in operation) this will cause current to pass from wire 367 through switch 369. The purpose of this is to drive the motor so that the piston will move (going upwards). Note that when "off" relay 316 is in operation the rest of the unit has already been shut off via the pressing button 324.

Magnetic switch 315 will stop current going to "off" relay 316 when 305 is all the way up. This action is carried out by permanent magnet 311 mounted on top of 305 coming into contact with magnetic switch 315.

Relay 318 (the down relay) controls the down drive of motor 304. When relay 318 is energized then motor 304 is de-energized while when relay 318 is de-energized it will cause motor 304 to rotate so as to close piston 305 downward.

Relay 320 causes motor 304 to spin 305 upwards if both relays 318 and 319 are de-energized. This action will prevent motor 304 from burning out in case of a malfunction or current interruption to relays 318 and 319 (as they would release their bars). Relay 320 serves therefore to connect to the up drive only.

Motor 304 gets current from (1) "shut off" relay 316; (2) relays 313–320. Current to the motor from relay 316 is explained as follows:

Current comes from switch 357. Current will pass only when relay 318 is de-energized thereby closing switch 357, hence passing current from wire 358 to wire 356 to relay 320. Note that only when both relays 318, 319 are de-energized will relay 320 operate.

When relay 320 is energized it will disconnect current from relay 318 by opening switch 350. DC for relays 318, 319 is provided via wire 358 passing current to wire 378 of relay 379 to wire 379 of relay 319.

Describing now the operation of thermostat 380. Thermostat 380 is a combination of five parts: 3 magnets, 2 magnetic switches, 1 meter, 1 thermostatic metal.

Meter 328 is a heavy duty meter which has the capability of moving the scanner up and down on the face of thermostat 380. The movement across the face is accomplished by the volume control 210, which when there is an increase in current, will cause the meter 328 to move scanner 211 to the right towards magnet 212. When current decreases, it causes meter 328 to move the scanner to the left towards magnet 213. Magnetic switch 330 when closed will cause it to conduct electricity through it. This action will pass current from line 341 to 342 in turn passing current to wire 377 of relay 318, thus engaging relay 318. Note that once relay 318 is energized by switch 330 it will stay "on" even after the magnet is away from switch 330 because switch 361 keeps relay 318 locked in.

Magnetic switch 329 acts exactly as does magnetic switch 330 except that switch 329 activates relay 319 by passing current from wire 342 to switch 329 to wire 244 to wire 345, to wire 375 of the relay coil. Once relay 319 is triggered it will be kept energized by switch 364, and would only release its bar when relay 318 is energized.

Magnet 214 is the scan locker, meaning, this will stop the movement of scanner 211 from scanning. This is don by magnet 214 magnetically switching switches 329, 330 so that current will disconnect from motor 304 stopping movement of the piston and volume control 312 keeping current to meter 328 steady thus stopping scanner 211.

Magnet 212 is so positioned so that it will activate magnetic switch 329 only, thereby causing scanner 211 to move back to the the left side.

Magnet 213 is so positioned that it will only activate magnetic switch 330 causing scanner 211 to go toward the right.

The Purpose of magnet 213 is as follows: if for some reason scanner 211 passed permanent magnet 214 thus going toward magnet 213, then 213 would cause it move back to permanent magnet 214. Normally however, scanner 211 would never pass permanent magnet 214 unless caused to by setting thermostat arm 225 to a different location or when there was an interruption of electricity, as explained previously. However magnet 214 is so constructed so that when it moves to either side it will keep the magnetic field under both magnetic switches equally balanced.

Pointer arm 225 enables the setting of different degrees. When 225 is moved, 214 moves along with it, hence giving the thermostat a new reading.

Expanding and contracting rod or metal M of the thermostat which expands or contracts with changes in temperature is mounted on thermostat arm 225 so that when arm 225 moves so will expanding rod to give thermostat a new reading.

Relay 321 would be employed in larger units requiring a contact relay (with high amperage contacts on switch 381 being able to handle a large compressor). Current comes from wire 332 which is connected to wire 361 from the motor which is connected to wire 333. Wire 382 is connected to relay 317, hence, when relay 317 is activated contacts 381 close thereby starting the compressor. When relay 317 is deactivated, relay 321 is also. Note that relay 321 is not necessary in small units.

It should be noted that the automatic adjusting means adjusting the cavity of the chamber wherein the refrigerant is forced may also control simultaneously motor 207 in FIG. 5 geared to one other chamber similar to 208, but larger in size whereby the output of the cooling system or the the output of the heating and cooling system may be channeled to the second chamber. The second chamber would be so calibrated so as to effect continuously and automatically a calibrated supply volume of heated or cooled air to at least one given area whereby the actual temperature of the given area equal that of the desired temperature setting. Of course the chamber may operate whereby the output of any such system id channeled to another chamber.

In order to coordinate the component of FIG. 6 with the blocks in FIG. 5 the following is a listing of both figures.

| Parts in FIG. 6 | Block No. in FIG. 5 |
|---|---|
| Power supply (DC) 322 and AC line from plug 301 | 201 |
| "On" relay 317 and switch 323 | 202 |
| Relay 316, switch 324 | 206 |
| Switch 315 | 222 |
| Relay 319 | 204 |
| Relay 318 | 205 |
| Relay 320 | 203 |
| Motor 304, gear 303 | 207 |
| Piston (or faucet) 305, screw 307, permanent magnet 311, chamber 302, permanent magnet 306, adjusting screw 310 inlet pipe 308, outlet pipe 309 | 208 |
| Container 312, permanent magnet 313 plate 314, hinge 362 | 209 |
| Meter 328 | circle 210 |
| Scanner 211 | scanner 211 |
| Magnet 212 | magnet 212 |
| Magnet 213 | magnet 213 |
| Magnet 214 | magnet 214 |

FIG. 6 is a drawing of the manual and automatic operation and circuitry of FIG. 5. Both FIGS. 5 and 6 disclose the operations of controlling the size of the cavity and/or orifice of chamber 18 in FIGS. 1, 1A thereby controlling the operations of controlling pressure, hence controlling temperature as disclosed in the disclosure of FIGS. 1, 1A and Table 1. Hence, FIG. 5, 6 illustrate automatic control and manual control 310, functionally identical to 12 in FIGS. 1, 1A is operated manually by hand as disclosed for 12 in FIGS. 1, 1A or as a function of user preference, having motor 111 of FIGS. 2–4 geared to 310 whereby the manual control is performed via motor 111. Hence the apparatus of FIG. 6 may be operated manually and/or automatically at the option of the user.

Figure 10:
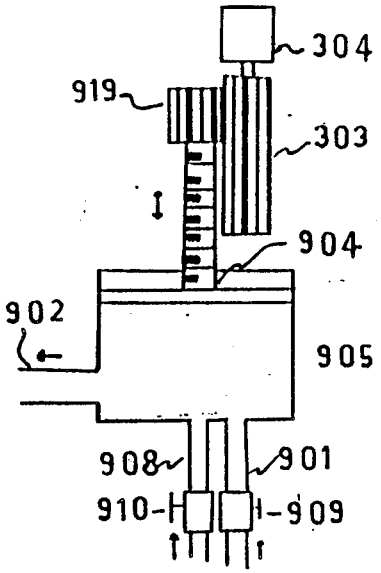
FIG. 10 is a drawing of the operation of a device controlling supply volume.

The apparatus disclosed in FIG. 6 may control at the user's option also current requirements to the compressor motor (when gear 419 of FIG. 8 is geared to gear 303 and when the compressor motor is connected to on of the outlets of FIG. 8); also controlling circuit breaking means which is reset automatically to a power supply upon stabilization of calibrated current (when gear 419 of FIG. 9 is geared to gear 303 of FIG. 6) such that FIG. 6 enables automatic control of current requirements of the refrigeration circuits disclosed in FIGS. 1, 1A in a relationship to temperature as disclosed in Table 1. Manual control of FIGS. 8, 9 is provided when gear 419 of FIG. 8, 9 is geared to 310 of FIG. 6 thereby providing manual and/or automatic control of the means disclosed in FIGS. 8, 9 as a function of user preference. Gear 919 of FIG. 10 is also geared to 303 and/or 310 thereby enabling the control of supply volume manually and/or automatically by the operations of FIG. 6.

In FIG. 6 there are two power supplies: (1) 110 volts via plug 301; (2) a DC power supply 322 providing power to all DC relays and components.

Motor 304 will turn gear 304 increasing pressure (and current requirements when gear 419 of FIGS. 8, 9 is geared to 303 increasing the size of the gap of core C) the operation of 305 and 307 is similar to the operation of 12 and 13 respectively in FIG. 1, whereby motor 304 controls 305 via 303 thereby controlling the refrigeration circuit of FIG. 1 via piston or the expanding and contracting means as shown in FIG. 1. The right and left side of chamber 18 are represented by 308 and 309 in FIG. 1 respectively.

FIG. 7 shows how a piston (or faucet type thermostat is applied for heating as well cooling in heat pump systems. Note that block 18 is designated to represent the piston which may be controlled manually or automatically as shown in FIG. 1–7.

Figure 7A:
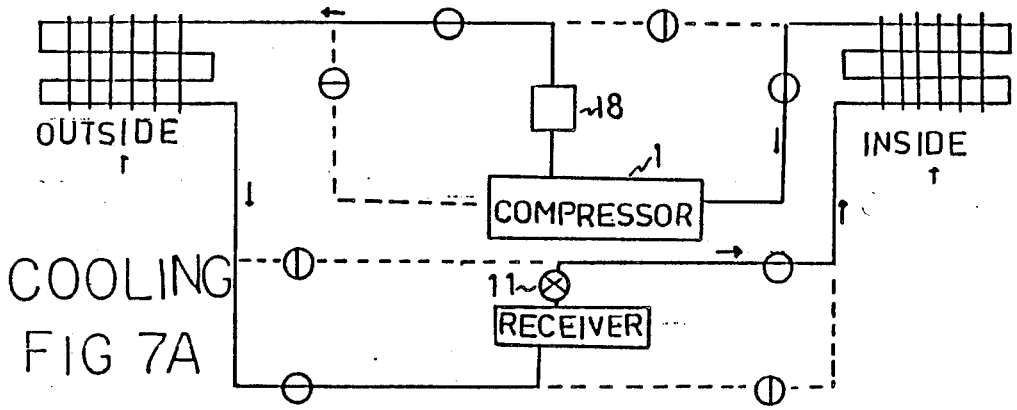
FIG. 7A is a drawing of an air-to-air heat pump system hooked up for cooling effect, temperature control by one of the FIG. 1–6.

FIG. 7A represents an air to air heat pump system for providing also a cooling effect therefore providing the operation as a refrigeration mechanism in which heat at temperatures too high for use for cooling is extracted in the evaporator 9 (inside surface pumped by the refrigeration mechanism to a condensing medium (outside surface) 10 either air or water but in this illustration, outside air.

Figure 7B:
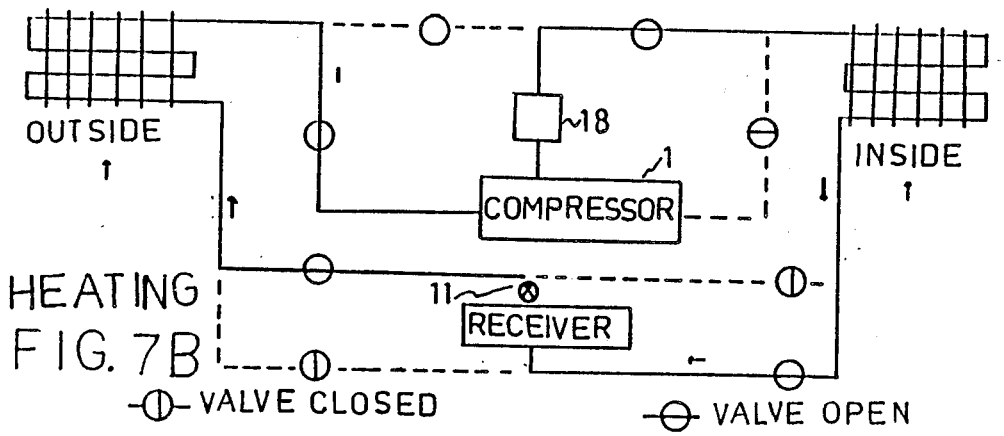
FIG. 7B is a drawing of an air-to-air heat pump system hooked up for heating effect, temperature control by one of the FIGS. 1–6.
Figure 7C:
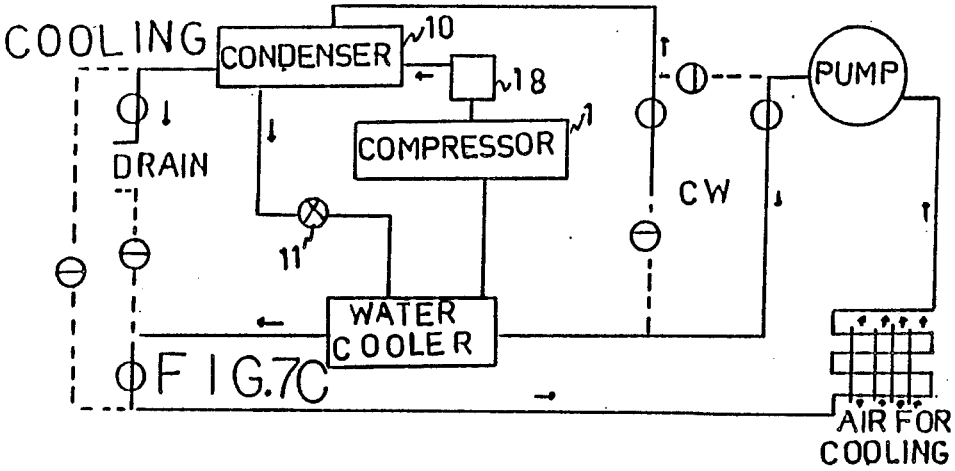
FIG. 7C is a drawing of a water-to-water heat pump system hooked up for cooling effect, temperature control by one of the FIGS. 1–6.

FIG. 7B is an air to air heat pump system for a heating hook up, whereby the valves on the hatched lines are closed thereby providing a system in which heat at levels to low for heating is absorbed by the evaporator 9 (outside surface) pumped by the refrigeration mechanism to a condensing medium (outside surface) 10 either air or water but in this illustration, inside warm air. Chamber 18 has a piston that adjusts the cavity of the chamber.

Figure 7D:
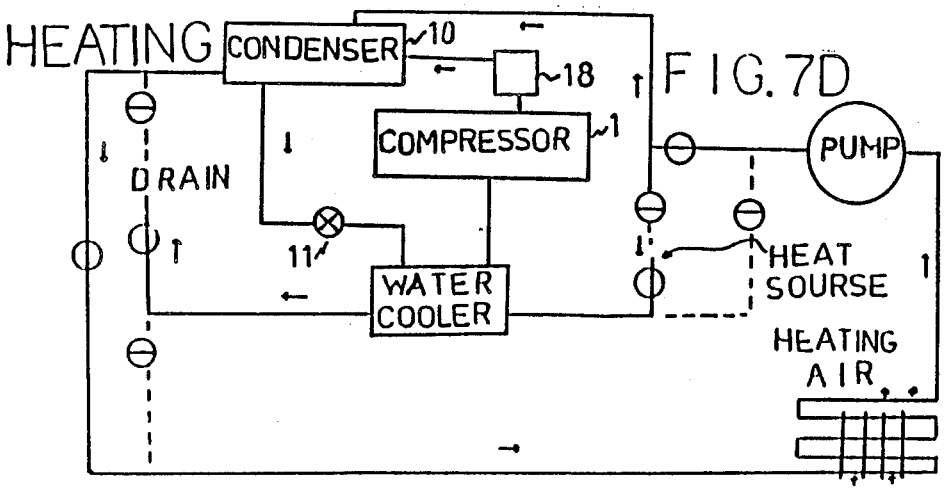
FIG. 7D is a drawing of a water-to-water heat pump system hooked up for heating effect, temperature control by one of the FIGS. 1–6.

FIG. 7D is a water to water heat pump system for a heating hook up whereby air to be warmed is passed over pipe coils in which warm condenser water is recirculated. The water from the heat source is channeled to the drain and rejected after passing through the water cooler.

In larger plants the air is purified, cooled or heated, humidified or dried, according to the need, by the air conditioning plant and circulated through the building by means of ducts as follows:

(1) air enters a section where it mixes with re-cycled air from the building; (2) mixed air passes through a filtering section (not shown); (3) air temperature is controlled by passing the air through two tube banks in which one is of hot water or steam (not shown) and the other is a refrigerant.

A temperature sensor is usually located inside the room and connected to the plant and set to the desired temperature setting whereby the difference between the temperature needed and the actual temperature automatically determines which of the two tube banks is to be used.

In larger buildings the plant may supply air at a fixed temperature and local duct heaters in different rooms or building zones provide final temperature control in each room or zone; or one duct carries warm air while another carries cold air and whereby both are mixed at a given point for desired temperature or whereby the supply volume of air is controlled automatically by piston 208 and the circuitry of FIGS. 5, 6 to any room or zone. Such larger plants maybe visualized as follows: (1) fresh air intake (2) filtering system (3) cooling unit (as described in FIGS. 1–6 with the cooling tubes contained within the unit so as to cool the air passing them) (4) heating unit (with the heating tubes contained on line within the unit so as to heat the air passing them) (5) odor filter (of activated carbon for absorbing odors) (6) water spray humidifier (7) fan (8) diffuser (the hot and/or cold air is delivered into the room through slots or grills in the walls close to the ceiling or within the ceiling (9) exhaust duct.

The principles of the present invention may also be applied to the heating unit whereby temperature may be controlled by controlling pressure, as follows:

In a closed system such as described previously for air conditioning and refrigeration systems (see FIGS. 1, 1A, 3, 5, 6) and cooling/heating heat pump system (described in FIGS. 7A–D) the heating/cooling medium recirculates. Similarly with heating systems the heating medium recirculates steam heating. For example, chamber 18 containing a piston as described in FIG. 1A or metal strip as described in FIG. 1 (or both) may be located in the steam riser pipe(s) whereby more or less of the heating medium by be drawn off. (The chamber described in FIG. 1 may also be connected to the return.) When a higher temperature is desired the piston or metal strip is made to close whereby pressure in the system is increased and more heat is created in the system thereby. Both the heat pump systems (described in FIGS. 7A–D) and any other closed system heating may operate manually (see FIGS. 1, 1A) semi automatically (as described in FIGS. 2–4) or automatically (as described in FIGS. 5, 6).

The closed systems for heating wherein the present invention may be applied with varying degrees of success are: Steam Heating loops: (a) vapor heating systems (b) vacuum heating systems. Chamber 18 would be hooked up to the heat supply pipe(s).

Air conditioners and refrigerators now would require low start up amperage and compressors would not longer require stating windings because of the operation described in FIGS. 3, 6. Also the temperatures would not vary greatly in heating or cooling systems from shut down to start up of the system as the system may be made to be always "on" unless manually shut off hence providing for savings in fuel and repair and replacement costs.

It is a further objective of this application to show how the current to the compressor motor is controlled precisely, the control being correlated to the ambient temperature of the area to be conditioned. Hence, the 60 degree e.g. setting controlling the current input to the compressor motor of the refrigeration circuit such that the current input is calibrated for most efficient output for 60 degrees e.g. and the output is maintained.

Plug 1 is plugged into an AC power supply in FIG. 8. Switch 427 opens of closes the circuit. The compressor motor is plugged into any of the outlets 413–415. Meter 420 shows the output to the connected motor(s). The three different coils extend to three different outlets, with three different current ratings. Coil 404 extends to outlet 415 which has an amperage output of 5 amperes e.g. coil 405 extends to outlet 415 which has an amperage output of 10 amperes and coil 461 extends to outlet 413 which has an amperage output of 1 ampere e.g. The three outlets 413, 415, 414 are served respectively by switches 413A, and 415A, and 461A, either enable independent operation and control of the current passing to the separate outlets, or enable jointly the operations and controls of the current passing to the concurrent outlets. When the switches are closed, the current passes jointly to all three of the outlets. When one switch is closed and the others are opened only the current to the outlet having the closed switch is controlled. Gear 419 controls the elevation of metal bar B thereby controlling the size of the gap of the reactor means having magnetic core C, such that when bar B is elevated the gap is increased, thereby allowing more current to the outlets. Lowering the bar over core C decreases the gap thereby decreasing the current to the outlets and the connected refrigeration circuit, in a calibrated relationship to the increase or decrease of refrigerant to the circuit. Gear 419 is geared to 12—12 having gearing means (not shown) in FIGS. 1, 1A or geared to the gear of motor 111 in FIGS. 2, 3 or geared to motor 207 in FIG. 5 or to 303 and/or 310 in FIG. 6. Thus a calibrated relationship may be made and the relationship controlled whereby the current to the compressor motor connected to FIG. 9 is proportionately controlled in relationship to the pressure requirements of the refrigeration circuit in producing an ambient temperature equal to a selected temperature setting, when the current being controlled in a relationship to the amount of refrigerant in a refrigeration circuit to attain a selected temperature. Diode 11 via filter capacitor 17 changes AC to DC going to meter 420.

FIG. 9 is a drawing of circuit breaking means functioning to make or break the circuit having a plurality of refrigeration circuits connected to circuit breaking means upon a current beyond the one correlated to produce the ambient temperature of a given area correlated to the amount of refrigerant in the refrigeration circuit as explained in the disclosure concerning FIG. 8. Should there be a current overload, current to one or more refrigeration circuits is cut off automatically with current reinstated automatically to the circuits upon stabilization with the controlled relationship.

In FIG. 9 all the identically numbered parts as in FIG. 8 operate as disclosed in FIG. 8. The following additional parts provide circuit breaking means. The voltage applied to coil 529, a maximum output of 10 volts e.g. activates relay 522 thereby drawing in relay bar 523, thereby opening switch 525 enabling the opening of the main circuit that extends down to plug 401. The opening of the main circuit will not take place until there is an increase of more that 1 ampere e.g. above the current allotment to the compressor motor(s). Variable resistor 519 operating in conjunction with gear 419 functions as follows: When bar B is fully raised over the gap of core C whereby maximum current is fed to compressor motor(s) relay 522 is set to its lowest sensitivity thereby requiring a large current change to induce a high enough voltage across coil 529 in order to activate relay 522 whereby drawing in relay bar 523. When bar B is lowered over gap of core C whereby fully covering it, relay 522 is set to its highest sensitivity. At this point resistor 519 is set to maximum whereas when bar B was fully raised over core C, 519 was set to minimum. Thus gear 419 being geared to 12 (or 13) in FIGS. 1, 1A, gear of motor 111 in FIGS. 2–4, gear of motor 207 in FIG. 5 operating in conjunction a variable resistor 519 functioning to trip relay 522 upon a short or overload above the allotment to break the circuit. Contacts 525 and 526 are partially magnetized to resist rumble and to close the relay contact, thereby stabilizing the current passing to these contacts. The two magnetic contacts 526 when tripped hold the main circuit open. To turn current back to on, switch 523 is manually tuned to on, after the defective device has been disconnected. When magnetic contacts 526 are removed the relay 522 will reset itself automatically when the defective load is removed. Capacitors 521, 524 and 571 function as follows: filter capacitor 521 purifies DC for stable operation of relay 522; 524 reduces the sparking of contacts 525, 526 when opening and closing the main power switch; 271 stabilizes meter 120 of DC ripple. Hinge H in FIGS. 8, 9 is used as an aid in moving bar B.

FIG. 10 illustrates haw a supply volume of heated or cooled air is calibrated by the size of the cavity of chamber 905 so as to effect continuously and automatically a temperature of a given area calibrated in a relationship to the supply volume, such that the actual temperature of an area is continuously equal to a selected temperature setting for the area. (The selected setting of the selected temperature is effected by 225 on meter 380 of FIG. 6) Input duct 901 feeds conditioned air into chamber 905 from an air conditioning system. More or less of the conditioned air is fed to the area via output duct 902. The supply volume is adjusted by piston 903. The piston is controlled by means disclosed in FIG. 6, such that when 919 is geared to 303 in FIG. 6 thereby providing automatic control of a calibrated supply whereby adjusting the temperature continuously up or down in accordance with the changes in the actual temperature of the area whereby the actual temperature is continuously equal to a selected temperature setting for the area. It should be noted that gear 906 and 907 may be placed on screw means 904 instead of 919 whereby enabling a calibrated supply volume for larger or smaller areas. Gear 919 being geared to 310 thereby enabling manual and/or automatic control of supply volume to the area. It should be noted that motor 207 in FIG. 5 and motor 304 in FIG. 6 control also faucet 17 of FIG. 1 and piston 18 when faucet 17 and piston 18 is geared to motor 207 in FIG. 5: also when 17 and 18 are geared to motor 304 in FIG. 6. Hence 307 in FIG. 6 may control faucet 17 and piston 18. Note also that motor 304 and gear 303 are provided with means that enable the disconnection of gear 303 and motor 304 from gear 305 thus providing manual and/or automatic operation of FIGS. 5, 6. Manual and automatic operation is provided when motor 304 is geared to 305 via gear 303 as shown in FIG. 6. The manual adjustment is provided by 310 performing the same function as 13 in FIG. 1. Manual or automatic operation is provided as disclosed in the disclosure of FIG. 6; also, it is provided when 304 and 303 are disconnected from 305 at the option of the user. Motor 304 and gear 303 may be mounted on a radial slide (not shown) or other apropiate guides or slides enabling 303 to mesh with gear 305 when automatic operation as described in FIG. 6 is desired. 303 may be placed in the position whereby gear 303 no longer meshes with gear 305 for manual operation. The manual and automatic operation combination is described in FIG. 6. See the disclosure describing the operation of manual adjustment 310.

Also, it should be clarified that 13 and 17 in FIG. 1 may control the size of the orifice of a system wherein refrigerant under high pressure may enter chamber 18 and refrigerant under low pressure enters chamber 18. The high and low pressure refrigerant is mixed. The orifice controlling the mixture is varied and regulated by one or more contracting and expanding means and piston means. Note that controlling the orifice via expanding and contracting means and piston means may apply when FIGS. 1, 1A is connected to a heating system wherein a heating medium, such as steam under high pressure and steam under low pressure is mixed in chamber 18.

Hence, FIGS. 1–4 may be used in conjunction with FIGS. 5, 6 thereby providing an apparatus with manual and/or automatic control means. Duct 901 feeds cold air to a chamber 905 while duct 908 feed hot air to chamber 905. The amount of cold air is controlled by valve 909. The amount of hot air is controlled by valve 910.

Figure 11:
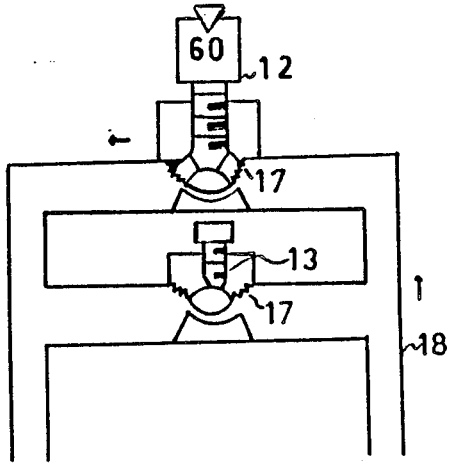
FIG. 11 is a drawing of the faucet type thermostat controlling a closed heating circuit.
Figure 11B:
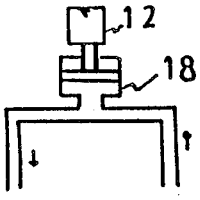
FIG. 11B is a drawing showing the drawing off of a high pressure heating medium from a closed heating circuit and the control of temperature thereby.
Figure 11A:
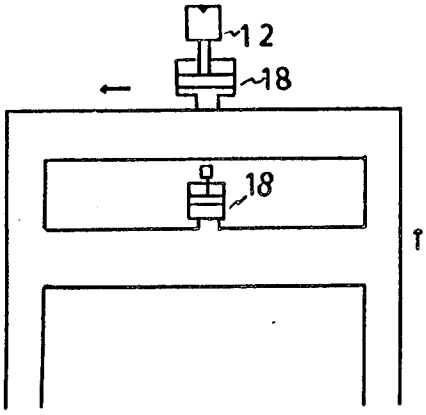
FIG. 11A is a drawing of the piston type thermostat controlling a closed heating circuit.

FIG. 11 is a drawing illustrating the operation applying to heating systems disclosed previously. As in FIG. 1A components 12 and 17 perform the function previously explained in the disclosure of FIG. 1A. The pipe with the arrow pointing upwards carries a high pressure heating medium (such as steam rising in the steam risers or steam main) and connecting it to a pipe carrying a low pressure heating medium (such as the return main above the water level), indicated by the arrow pointing in a downward direction. The mixing pipe for mixing the high pressure and low pressure medium is controlled by 12 and 17. 12, having gearing means (not shown) may be geared to 303 (in FIG. 6) at the option of the user thereby providing automatic control of temperature. This is in keeping with the functions disclosed for FIG. 6 describing the automatic control of pressure. FIGS. 11, 11A, 11B provides the means for controlling the size of the orifice of chamber 18 such that when 18 is connected to to a closed heating circuit whereby a high pressure and low pressure medium is mixed (as shown in FIG. 11) or when a high pressure medium is dawn off (as shown in FIGS. 11A, 11B) by piston means the actual temperature of an area becomes equal to a selected temperature setting for the area. The pressure requirements of the heating circuit is controlled inversely proportional in accordance with changes in the actual temperature. The automatic means (of FIG. 6) determine whether the the actual temperature is above or below the selected temperature. FIG. 6 illustrates the means operably connected to FIGS. 11–11B for controlling the size of the cavity and orifice of chamber 18 such that the pressure requirement is adjusted in a relationship to actual temperature changes for providing an immediate corrective increase or decrease in the pressure requirements in accordance with these changes and in accordance with changes in the selected temperature setting. The maintenance of the equal temperature is thereby provided without great variation.

Manual operation of FIGS. 11–11B is achieved when 12 is adjusted manually. Hence FIG. 6 discloses the automatic and/or manual operations of FIGS. 11–11B.

Figure 12:
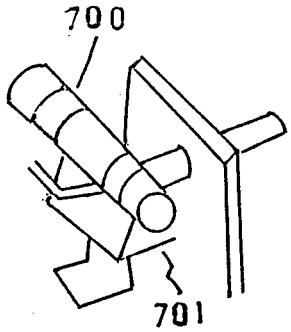
FIG. 12 is a drawing showing the control of the pump and fan of an oil burner when connected to FIG. 9.

In the oil burner of FIG. 12 when oil pump motor 701 and blower motor 700 are connected to 415 and 414 in FIG. 8 or are represented as the 5 amp motor and 1 amp motor in FIG. 9 then an adjustment of 419 in FIG. 8, 9 thereby manually controls the quantity of oil an any given moment, hence controlling the ambient temperature in a relationship. When 419 is geared to 303 of FIG. 6 701 and 700 are controlled automatically such that the current to these motors are immediately adjusted so that the oil burner provides a temperature of a controlled space that is continuously maintained to be equal to a point temperature of a temperature setting of 225 on meter 380 of FIG. 6 by increasing or decreasing the current input in a relationship in accordance with a deviation of the temperature of a space from a point temperature of a temperature setting for the space without the motor(s) cycling after the point temperature of the temperature setting is attained. When 700 and 710 are connected to FIG. 9 the circuit breaking and automatic reset features of FIG. 9 operate on 700 and 710. The above provides the following advantages: (1) continuous flow of heat at desired set temperature setting providing thereby greater comfort than the comfort provided by oil burners that cycle; (2) savings in oil consumption.

Figure 13:
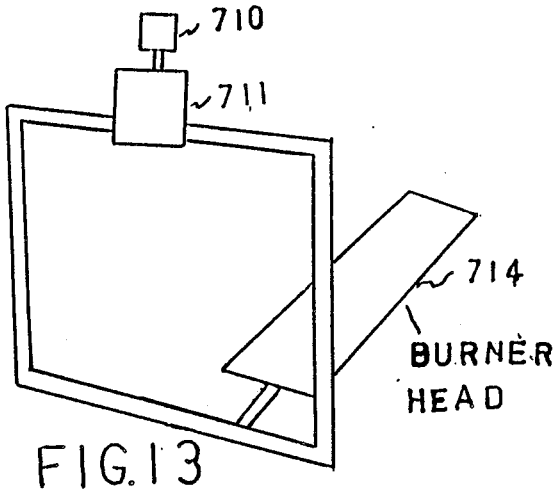
FIG. 13 is a drawing of a gas burner.

Gear 710 in FIG. 13 of gas control valve 711 may be controlled manually via 710 (or via smaller or larger gears providing smaller or larger gear ratios 906, 907) thereby varying or regulating the intensity of the flame of the gas burner head 714, hence varying or regulating the temperature of a space conditioned by the burner. The same may be effected automatically when 710 is geared to 303 of FIG. 6 and a temperature sett on 225 of FIG. 6. Component 711 comprises one of the components of FIG. 11–11B controlling its pressure. Hence the disclosure of FIG. 11–11B may be read into FIG. 13 by substituting "12" for 710. The gas burner will operate without cycling after the point temperature of a temperature setting on 225 of FIG. 6 is attained when the apparatus of FIG. 6 provides automatically an increase or decrease in gas pressure via controlling 710 in accordance with a deviation of a temperature of a space from a point temperature setting by 225 of FIG. 6, thus maintaining the temperature of the space equal to the point temperature of the temperature setting.

It should be noted that apropiate radial slides or guides (not shown) provide the connection or disconnection to and from gear 303 of any one or more of the gears shown in FIG. 6, 25 such that they mesh or do not mesh.

Figure 14:
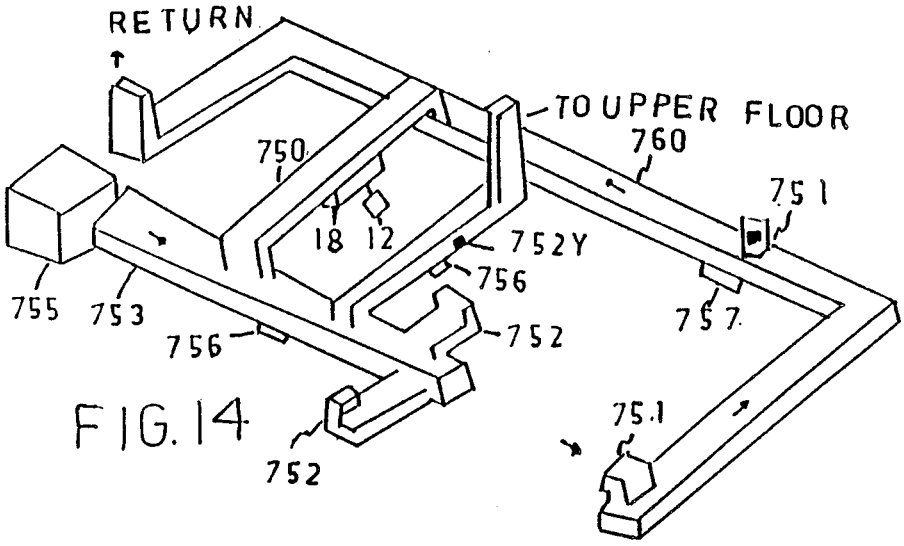
FIG. 14 is a drawing of a plenum system for use in conjunction with cooling or heating systems.
Figure 15:
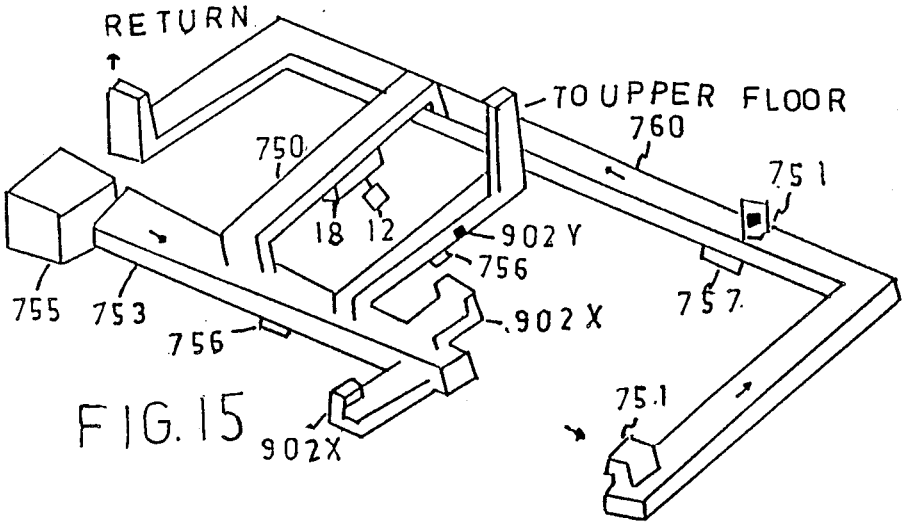
FIG. 15 is a drawing of a plenum system for use in conjunction with a supply volume system.

FIG. 15, is drawing of plenum systems controlling the upper and lower floors of a building. Shown in FIG. 14, 15 is a chamber 18 and 12 of FIG. 1–1B, 11–11B controlling the pressure of a medium of a refrigeration circuit and/or heating system described in the disclosure of FIG. 1–1B, 11–11B thereby controlling the temperature or humidity output of these systems controlled manually via manual control of 12 or automatically (when 12 is geared to 303 of FIG. 6). The air velocity may in FIG. 14 likewise be controlled by controlling the current input to fans 756, 757 (when the fans are geared to 419 of FIG. 9). Likewise supply volume of the supply volume system of FIG. 10 may be channeled via ducts 750–753, 760. Gear 919 (see FIG. 10) may be controlled manually or geared to gear 303 of FIG. 6 thus controlling piston 904 (see FIG. 10) thereby controlling a supply volume of heated and cooled air to a space, controlling temperature thereby.

Figure 16:
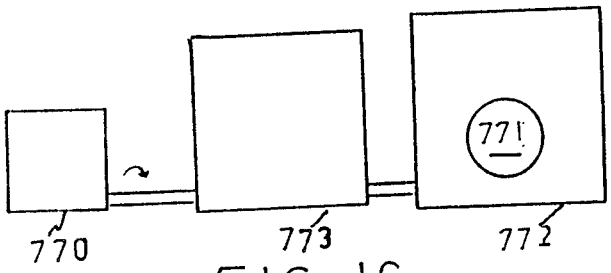
FIG. 16 is a drawing of the operation of an automatic motroized coal burning system. One or more motors of the system are controlled by 419 of FIG. 9 manually or autmatically (by 419 controlled by 303 of FIG. 6) in a relationship to a point temperature of a temperature setting.

FIG. 16 is a drawing of the operations of an automatic motorized coal burning system. The current input to one or more motors of the system is controlled by 419 in a relationship to a temperature setting when these motors are connected to FIG. 8, 9 and 419 or FIG. 8, 9 is controlled manually and automatically when 419 is geared to 303 of FIG. 6. Stoker motor 770 controls the amount of coal that is automatically fed into a furnace or boiler 772 from hopper 773 and the fan motor 771 serves to draw the necessary air for proper burning of the coal. Hence furnace 772 may remain in operation without cycling after the temperature of a space becomes equal to the point temperature of a temperature setting.

It should be noted that 12 of FIG. 1–1A, 11, 13 may list thereon calibrated psi pressure producing a corresponding temperature for a given space. Likewise calibrated current temperature/humidity/air velocity relationships may be listed on 419 (906, 907) of FIG. 8, 9, hence providing an air for manual control adjustments.

Figure 17:
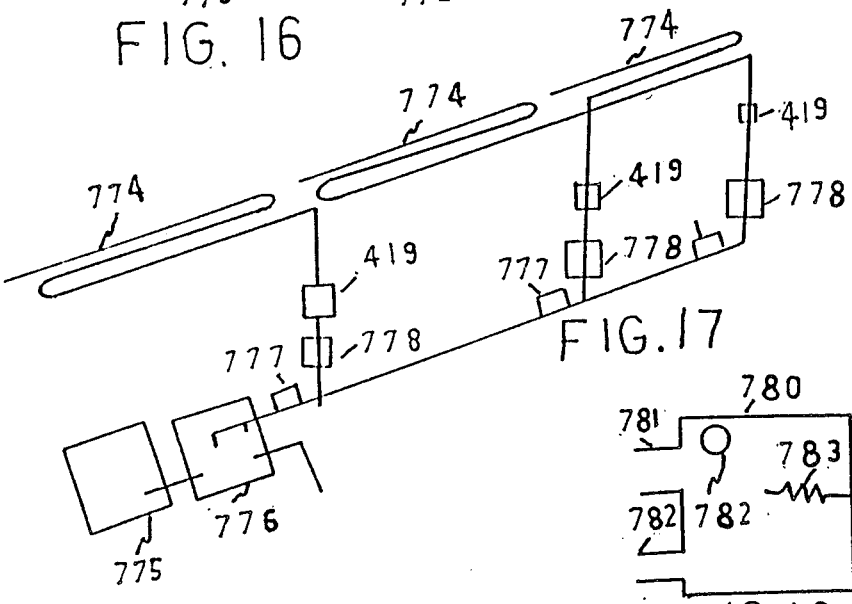
FIG. 17 is a drawing of the operation of a radiant electric heating system, and includes a hot water heating system.

In FIG. 17 the operation of an electric heat system is illustrated. The heating elements are represented by 774. Small panel wall heaters and baseboard heaters are represent by 778 and 770 respectively. Each room may have its own thermostat represented by 419 which may manually adjusted for manual operation or automatically adjusted when 419 is geared to 303 of FIG. 6. [Note that the electric hot water system 775 may also be likewise controlled by 419 when connected to the system via distribution box 776.] The automatic control of current input to the apparatus is controlled in a relationship in accordance with the deviation of a temperature of a space controlled by the apparatus from a point temperature of a temperature setting of 225 on meter 380 of FIG. 6.

Figure 18:
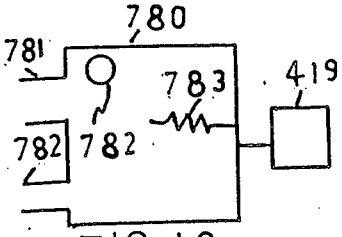
FIG. 18 is a drawing of a hydronic boiler that is controlled manually or autmatically by 419 of FIG. 9 geared to 303 of FIG. 6.

In FIG. 18, immersion coil 783 of hydronic boiler 780 is connected to FIG. 8 or 9 and 419 of 8 or 9 is controlled manually or automatically visa the connection of 419 to gear 303 of FIG. 6. and current to it is controlled in the same way as described for the system of FIG. 17. Boiler 780 uses a fast acting coil 783 heating water pumped to radiators by circulating pump 784 via supply line 781. The water returns to the boiler via return line 782.

Figure 19:
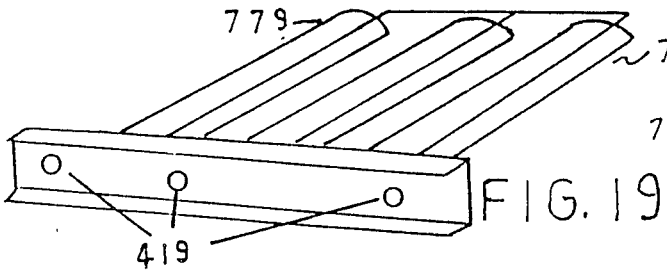
FIG. 19 is a drawing of an electric furnace, controlled manually or automatically when 419 is geared to 303 of FIG. 6. One or more apparatus of FIG. 1–24 requiring identical or divergent current input for operation may be connected to an controlled by FIG. 9.

The identical or divergent current requirements of heating elements 779 of an electric furnace of FIG. 19 are controlled by 419 when these elements are connected to 413–415 of FIG. 8 and are each controlled by switches 413A–415A of FIG. 8. or represented by squares marked 1, 5, 10 amp motors of FIG. 9. 419 of FIG. 8 or 9. Current inputi is controlled manually in accordance with a calibrated reading on 419 or automatically 419 geared to 303 of FIG. 6. The automatic control of current input to the apparatus is controlled in a relationship in accordance with the deviation of a temperature of a space controlled by the apparatus from a point temperature of a temperature setting of 225 on meter 380 of FIG. 6.

Figure 20:
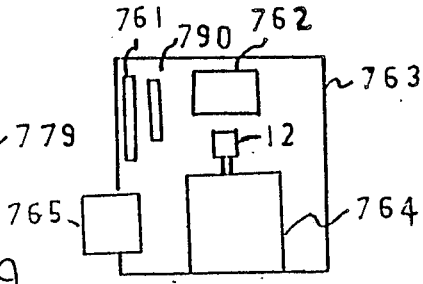
FIG. 20 is a drawing of a dehumidifier containing the refrigeration circuit of either FIG. 1, 1A. controlled manually and automatically when 12 is connected to FIG. 9.
Figure 21:
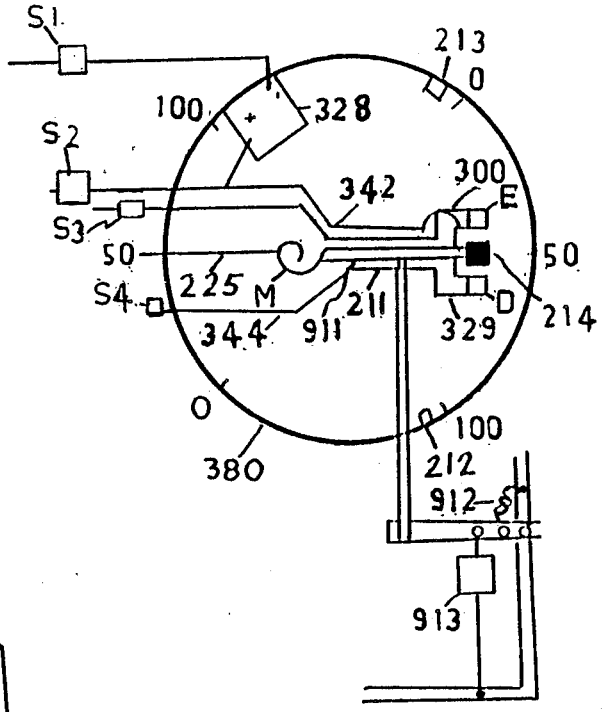
FIG. 21 is a drawing of a hygrometer device. The operation of all components shown in FIG. 6 operate in FIG. 21 are identical to the operation of components shown in FIG. 6 and should be read into FIG. 21 as if they were included in FIG. 21 in the identical position as they appear in FIG. 6 continuing from lines 342, 344. Components in FIG. 21 having numbers that are different than those in FIG. 6 are explained in the disclosure of FIG. 21.

FIG. 20 represents a dehumidifier (which is controlled via the apparatus of FIG. 21). The pressure to the compressor of the refrigeration circuit 764 may be controlled manually via 12 (see the disclosure to FIG. 1). or automatically when 12 is geared to 303 of FIG. 6 as controlled by the apparatus of FIG. 21. Current to the compressor of the dehumidifier may be controlled manually via gears 419 (906, 907) having relative humidity markings thereon, or controlled automatically when 419 is geared to 303 of FIG. 6 and controlled by the apparatus of FIG. 21 in a relationship in accordance with the deviation of a temperature of a space from a point temperature of a temperature setting of 225 on meter 380 of FIG. 21. Fan 762 of dehumidifier 763 may be likewise controlled, such that it does not cycle on and off. The drying coil is represented by 790.

FIG. 21 represents a hygrometer device that is connected to a device such as described for FIG. 6 at points S1–S4 shown in FIG. 6 and 21. Dial 225 of FIG. 21 sets the desired relative humidity for the controlled space. Human hair (or other suitable materials including animal tissue, paper and wood) 913 having the characteristic of changing its length in accordance with relative humidity changes is coupled as shown to dial 911 which shows changes in percentages of relative humidity on meter 380 calibrated to show readings from 0 to 100% relative humidity. Magnet 214 now moves in a relationship in accordance with the movement of 911. Spring 912 provides the means for resistance such that dial 911 may operate properly. Dial 225 provides the means for setting of the relative humidity desired. M is similar to M described in FIG. 6 except M in FIG. 21 does not respond to temperature changes but is merely flexible material and functions only with respect to the flexiblility decribed in the disclosure of FIG. 6 in accordance with the movements of 211. When S1–S4 of the apparatus of FIG. 21 is connected to S1–S4 of FIG. 6 respectively, all other components having identical numerarls as those in FIG. 6 function identically as described in FIG. 6, except that "relative humidity" should be substituted for "temperature" in the disclosure of FIG.

The apparatus of FIG. 6 and 21 may be used in conjunction to provide an effective temperature (intergrating the effects of humidity and temperature), by e.g., setting 225 of FIG. 6 or 79 degrees and 225 of FIG. 21 on 10% relative humidity.

Sultriness limits of a conditioned space may also be set on meter 380 of FIG. 6 and 21 in accordance with the following table tabulated by Hygienist, H.E. Lansberg for restive people:

| | | | | | |
|---|---|---|---|---|---|
| Temperature degrees C. | 40 | 35 | 30 | 25 | 20 |
| Relative humidity percent | 20 | 33 | 44 | 60 | 85 |

Meters 380 of FIG. 6, 21 may also be set to provide desired selections in accordance with the Temperature Humidity Index (THI) employed by the U.S. Weather Bureau.

It should be noted that a refrigeration circuit normally conditioning the temperature of a space may be connected to 419 of FIG. 8 and 9 and 419 geared to 303 controlled by meter 380 of FIG. 21 such that the same refrigertion circuit conditioning the humidity of a space maintaining a humidity of a space equal to the point humidity of a humidity setting on meter 380 without the aid of a drying coil and without any modification of the compressor or the refrigeration circuit. Likewise, 12 of a refrigeration circuit of FIG. 1, 1A normally conditioning the temperature of a space may be geared to 303 controlled by meter 380 of FIG. 21 such that the same refrigeration circuit conditioning the humidity of a space maintaining a humidity of a space equal to the point humidity of a humidity setting on meter 380.

Figure 22:
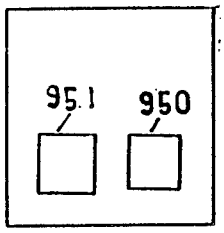
FIG. 22 is a drawing of a humidifier.

FIG. 22 represents a humidifier. By connecting fan motor 951 to 413–415 of FIG. 8 or connecting it to FIG. 9 (as represented by 1 amp motor) 419 may control the humidity of a conditioned space automatically when 419 is geared to 303 of FIG. 6 as set on 225 of meter 380 of FIG. 21 thereby controlling current input to motor 951 in a relationship in accordance with the deviation of the humidity of a space from a point humidity setting of 225.

Figure 23:
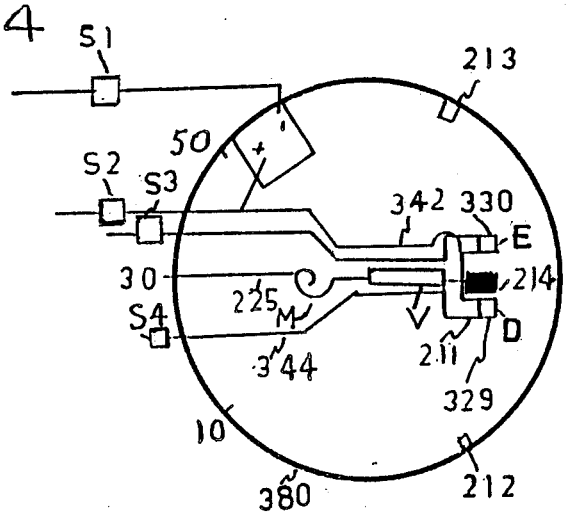
FIG. 23 is a drawing of a device controlling air velocity. The operation of all components shown in FIG. 6 operate in FIG. 23 are identical to the operation of components shown in FIG. 6 and should be read into FIG. 21 as if they were included in FIG. 21 in the identical position as they appear in FIG. 6 continuing from lines 342, 344. Components in FIG. 23 having numbers that are different than those in FIG. 6 are explained in the disclosure of FIG. 21.

FIG. 23 is a drawing of an apparatus providing a continuous control of an air velocity of a space to be maintained equal to a point air velocity of an air velocity setting of 225 on meter 380. Magnet 214 moves as a result of an increase or decrease of air velocity acting upon vane V. Flexible material M does not respond to temperature changes but merely retains the flexibility qualities described for M in FIG. 6 and moves in accordance with the movements of vane V. 225 serves to set a desired degree of air velocity for a controlled space on meter 380. All other components having identical numbers as those in FIG. 6 function identically as described in FIG. 6. When S1–S4 of the apparatus of FIG. 23 is respectively connected to the S1–S4 of the apparatus of FIG. 6 all other components of FIG. 6 function as described in the disclosure for FIG. 6 except "air velocity" is substituted for "temperature".

It should be noted that hair element 913 may be connected to bar 530 of FIG. 9 such that it serves to raise or lower bar B in accordance with changes in relative humidity. When meter 529 is calibrated to show changes in relative humidity it would reflect the changes in relative humidity of a space in accordance with the raising or lowering of bar B. Also, that vane V may be connected to bar 530 such that it serves to raise or lower bar B in accordance with changes in air velocity. When meter 529 is caliberated to show changes in air velocity it would reflect the changes in relative humidity of a space in accordance with the raising or lowering of bar B. When bar B is made of expanding and contracting material in accordance with changes in temperature bar B would be raised or lowered over core C in accordance with the temperature changes. When meter 529 is caliberated to reflect changes in temperature of a space it would reflect the changes in temperature of a space in accordance with the raising or lowering of bar B over core C. The raising or lowering of bar B over core C would thereby adjust the current input to the motors or other output devices connected to FIG. 9 in a relationship in accordance with the adjustment of the size of the gap between B and C in accordance with a reading of temperature, humidity, and air velocity on meter 529 when 529 is calibrated for same, hence serving a manual setting means for same. These facts may be utilized as follows: A manual setting of temperature may be provided by turning 419 so that it adjusts the gap between Core C and bar B in accordance with the temperature or humidity or air velocity reading on meter 529 calibrated previously by hair element 913, vane V and bar 530 of FIG. 9. with the motor or motors connected as shown to FIG. 9 maintaining the set poin temperature, humidity, and air velocity shown on meter 529 as set by 419 of FIG. 9 (with 530, V, and 913 removed since they are no longer required). Or after the gap had been set by 419 for a point temperature, humidity, and air velocity, bar 530 remains to react to temperature changes such that the size of the gap between B and C is increased or decreased in a relationship in accordance with the changes in temperature. The increase or decrease in the gap size serves to increase or decrease the current input to the motor (controlling the temperature) connected to FIG. 9. thereby controlling temperature of a space in a relationship in accordance with the temperature changes.

Meter 529 of FIG. 9 is connected to an oscillator and voltage detector 527 serving to change the oscillation of 527 upon a change in the size of the gap between B and C, since 527 acts as an FM discriminator such that a tuned circuit having its IF tuned to its oscillator, and resulting in detuning upon a change in frequency resulting the movement of bar B. The detuning causes a proportional loss in voltage thereby causing a change in the base circuit of the transistor (not shown) located in 527 and is reflected in the reading upon meter 529. Meter 529 hence provides a guide for varying or regulating 419 in adjusting the gap between bar B and core C in a relationship to temperature, humidity and air velocity, such that 419 may vary or regulate a desired point temperature, humidity, and air velocity setting thereby maintaining the point temperature, humidity and air velocity of the setting by the output devices connected to FIG. 9. by accordingly adjusting the current input to them via adjusting 419 in a relationship in accordance with a point temperature, humidity, and air velocity shown on meter 529. One or more meters 529 may be calibrated by temperature responsive means 530 and thereby reflect a temperature reading caused by temperature responsive means 530 expanding and contracting with temperature changes, thereby adjusting the size of the gap between bar B and core C via 419 in a relationship in accordance with temperature. One or more meters 529 may be calibrated by humidity responsive means 913 and thereby reflect a humidity reading caused by humidity responsive means 529 expanding and contracting with humidity changes, thereby enabling the adjusting the size of the gap between bar B and core C via 419 in a relationship in accordance with humidity. One or more meters 529 may be calibrated by air velocity responsive means V and thereby reflect an air velocity reading caused by air velocity responsive means V moving with air velocity changes thereby enabling the adjusting the size of the gap between bar B and core C via 419 in a relationship in accordance with air velocity. Hence 419 provides a manual adjustment of the curent input to one and a plurality of output devices connected to core C when 419 is adjusted manually. 419 provides an automatic adjustement of the current input in a relationship in accordance with temperature when 419 is geared to 303 of FIG. 6. Since one and a plurality of meters 529 may be calibrated in degrees of temperature and/or humidity and/or air velocity and/or current input one below another. One or more meters 529 may serve as a means for showing a degree of current usage in a relationship in accordance with a degree of temperature and/or humidity and/or air velocity of said space.

It should be noted that the refrigeration circuit of FIG. 1, 1A when it is connected to the apparatus of FIG. 9 and 419 is connected to gear 303 of FIG. 6 and FIG. 6 is connected to FIG. 21 at switching means S1–S4, the current to the compressor of refrigeration circuit of FIG. 1, 1A would be controlled so as to maintain a point humidity of a humidity setting shown on meter 380 of FIG. 21 even when the refrigeration circuit of FIG. 1, 1A operates without a drying coil.

Figure 24:
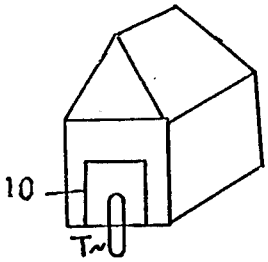
FIG. 24 is a drawing of the operation of a heat pump of FIG. 7–7D operating as a geosolar heat pump system.

The geosolar heat pump of FIG. 24 may be described such that the heat pump of FIG. 7–7D is connected to tube T containing a medium (antifreeze) to extract heat from the soil or rock or water below the ground or water level. Tube T forms a closed loop with a first end of the loop transferring heat extracted to freon in the evaporator 10 of the refrigeration circuit of FIG. 1.

It should be noted that when the threads of one of two gears 12 of two air conditioning systems of FIG. 1, 1A are reversed and both gears 12 are connected to gear 303 of FIG. 6 with the air conditioning units placed opposite each other, a person sitting between both units will find that one the units producing temperatures in an inverse proportional relationship to the temperatures produced by the other while at the same time both units operating in conjunction maintain the point temperature of the temperature setting of 225 of FIG. 6. (See FIG. 25) The same be may said for humidity when a humidity setting is made on 225 of FIG. 21. Likewise the same may be said for air velocity when two fans are each connected to an individual apparatus of FIG. 9 with a gear 419 of a first FIG. 9 having reversed threads from that of 419 of a second FIG. 9. and both 419s connected to 303 of FIG. 6 with FIG. 6 connected to FIG. 23 at S1–S4.

FIG. 25 illustrates the gearing of one or more apparatus of FIG. 1–22 to gear 303 such that gear 303 serves to provide one or more current input and/or pressure when controlling one or more apparatus shown connected to 303 providing the temperature, humidity, and air velocity of a space in a relationship in accordance with a deviation of a temperature of a space from the point temperature setting and in a relationship in accordance with a deviation of a humidity of a space from the point humidity setting and in a relationship in accordance with a deviation of an air velocity of a space from the point air velocity of an air velocity setting. Also illustrated how one or more of the apparatus shown geared to 303 of FIG. 6 may be (directly or inversely) geared to another one or more of the apparatus shown connected to 303 thereby providing the means for directly and inverse controlling a current input and a pressure of a medium of one or more of these apparatus while these apparatus simultaneously maintaining the point temperature of the temperature setting shown on meter of FIG. 6, the point humidity of the humidity setting shown on meter of FIG. 9 and the point air velocity of the air velocity setting shown on meter of FIG. 23.

What is claimed is:

1. A control apparatus comprising means for controlling a size of a first variable chamber such that said chamber controls a pressure of a medium of a first output device producing a point temperature of a space in a relationship in accordance with said size, said first output device comprising any one the following:

a first refrigeration circuit, a gas heating system, a steam heating system, and for simultaneously and independently controlling a current input to a second output device providing a point temperature of a space in a relationship in accordance with said input, said second output device comprising any one of the following: a compressor of a second refrigeration circuit, an oil burner pump motor, a motor of a motorized coal system, a conducting element of a hydronic boiler, a conducting element of electric heating system, and for controlling simultaneously and independently a size of a second variable chamber such that said chamber controls a pressure of a medium of a third output device producing a point humidity of a space in a relationship in accordance with said size, said third output device comprising a third refrigeration circuit, and for simultaneously and independently controlling a current input to a fourth output device providing a point humidity of a space in a relationship in accordance with said input, said fourth output device comprising a compressor of a fourth refrigeration circuit, and for controlling simultaneously and independently a current input to a fan motor providing a point air velocity in a relationship in accordance with said current input, first scanning means for scanning temperature responsive means thereby determining whether or not said size of said first chamber and said current input to said second output device is to be increased or decreased such that said increase or decrease providing a temperature of said space that is equal to the point temperature of a temperature setting, and wherein said medium pressure and said current input is increased or decreased in accordance with said determination, a first plurality of magnetic switching means, a first of said plurality of magnetic switching means activating and deactivating a first winding of said motor, a second of said plurality of magnetic switching means activating and deactivating a second winding of said motor, said magnetic switching means is controlled by a first magnet moving in and out of the magnetic influence of said magnetic switching means, such that said motor is activated when said temperature is not equal to the point temperature of said temperature setting, second scanning means for scanning humidity responsive means thereby determining whether or not said size of said second chamber controlling said medium pressure of said third output device and said current input to said fourth output device is to be increased or decreased such that said increase or decrease providing a humidity of said space that is equal to the point humidity of a humidity setting, and wherein said pressure and said current is increased or decreased in accordance with said determination, a second plurality of magnetic switching means, a first of said plurality of magnetic switching means activating and deactivating said first winding of said second motor, a second of said plurality of magnetic switching means activating and deactivating said second winding of said motor, said magnetic switching means is controlled by a second magnet moving in and out of the magnetic influence of said magnetic switching means such that said motor is activated when said humidity of said space is not equal to the point humidity of said humidity setting, third scanning means for scanning air velocity responsive means thereby determining whether or not said current input to a third motor is to be increased or decreased such that said increase or decrease providing said air velocity that is maintained equal to the point air velocity of an air velocity setting, and wherein said current input is increased or decreased in accordance with said determination, said air velocity is defined as a magnitude of the flow of said air from said fan to said air velocity responsive means, a third plurality of magnetic switching means, a first of said plurality of magnetic switching means activating and deactivating said first winding of said third motor, a second of said plurality of magnetic switching means activating and deactivating a second winding of said motor, said magnetic switching means is controlled by a third magnet moving in and out of the magnetic influence of said magnetic switching means such that said motor controlling said current input is activated when said air velocity is not equal to the point air velocity of said air velocity setting.

2. An apparatus of claim 1 comprising means for breaking a circuit connecting said second output device to any appropriate power supply upon a predetermined deviation beyond a said current input to said second output device operating in a relationship to said point temperature of said temperature setting, means providing wherein said broken circuit is reset automatically to said power supply upon alleviation of said deviation, means for breaking a circuit connecting said fourth output device to any appropriate power supply upon a predetermined deviation beyond said current input to said fourth output device operating in a relationship to the said point humidity of said humidity setting, means providing wherein said broken circuit is reset automatically to said power supply upon alleviation of said deviation, means for breaking a circuit of said fan motor connected to any appropriate power supply upon a predetermined deviation beyond a current input to said fan motor operating in a relationship to the said point air velocity of said air velocity setting, means providing wherein said broken circuit is reset automatically to said power supply upon alleviation of said deviation.

3. An apparatus of claim 1 comprising means for varying and regulating a first quantity of said medium under high pressure with a second quantity of said medium under low pressure thereby providing a resulting said medium pressure.

4. An apparatus of claim 1 comprising an oscillator and voltage detection means connected to a meter calibrated in measurements of temperature, humidity, and air velocity in a relationship in accordance with the adjustment of a size of a gap of a reactor means having an adjustable air gap, means for adjusting a degree of said current input in a linear relationship in accordance with a point of said measurements of said temperature and of a point of said measurement of said humidity of said space and of a point of said measurements of said air velocity.

5. An apparatus of claim 1 comprising wherein a first of a plurality of gearing means automatically varying and regulating an output of said first output device and an output of said second output device and an output of said third output device in a linear relationship in accordance with a varying and regulating: of a point temperature of said point temperature setting, of a point humidity of said humidity setting, of a point air velocity of said air velocity setting, and comprising wherein a second of said plurality of gearing means providing a said output of each of said output devices that is varied and regulated in a linear relationship to each other.

6. An apparatus of claim 1 wherein said first and second output device normally cycling after a temperature of a space conditioned by said output device becomes equal to the point temperature of a temperature setting, said apparatus providing means for the elimination of said cycling, and wherein said third and said fourth output device normally cycling after a humidity of a space conditioned by said output device becomes equal to the point humidity of a humidity setting, said apparatus providing means for the elimination of said cycling.

7. An apparatus of claim 1 comprising means providing wherein said second motor controls the said size of said first variable chamber and controls the said current input to said second output device such that said first and said second output device providing a maintaining of said point humidity of said space equal to a point humidity of a humidity setting for said space without modification of any operating component of said first and said second output device.

8. An apparatus of claim 1 comprising wherein said first, second, third and fourth output devices and said fan motor requiring divergent said current input for operation are controlled by a single circuit breaker.

9. An apparatus of claim 1 comprising wherein said first refrigeration circuit providing said maintaining of said point humidity of said humidity setting for said space without a drying coil.

10. An apparatus of claim 1 comprising means for manually varying and regulating a degree of said pressure and a degree of said current input in a relationship in accordance with a degree of said temperature, humidity and air velocity shown on dial.

11. An apparatus of claim 1 wherein said first refrigeration circuit operates in any one of the following: a first air conditioner, a first heat pump, a first geosolar heat pump system, and wherein said second refrigeration circuit operates in any one of the following: a second air conditioner, a second heat pump, a second geosolar heat pump system, and wherein said third refrigeration circuit operates in any one of the following: a third air conditioner, a third heat pump, a third geosolar heat pump system, a first dehumidifier, and wherein said fourth refrigeration circuit operates in any one of the following: a fourth air conditioner, a fourth heat pump, a fourth geosolar heat pump system, a second dehumidifier.

12. An apparatus of claim 1 comprising wherein said first motor also controls a size of a third variable chamber, said size controlling a quantity of heated and cooled air delivered to a space in a relationship in accordance with said size, means for controlling said size such that said size providing said point temperature of said temperature setting.

13. An apparatus of claim 1 comprising wherein said second motor also controls a size of a fourth variable chamber, said size controlling a quantity of humidified air delivered to a space in a relationship in accordance with said size, means for controlling said size such that said size providing said point humidity of said humidity setting.

14. An apparatus comprising means for controlling a size of a first variable chamber such that said chamber controls a pressure of a medium of a first refrigeration circuit such that said size providing a point temperature of a space in a relationship in accordance with said size and for simultaneously controlling a current input to a compressor of said first refrigeration circuit providing a point temperature of said space in a relationship in accordance with said input, and for simultaneously and independently controlling a size of a second variable chamber such that said chamber controls a pressure of a medium of a second refrigeration circuit such that said size providing a point humidity of said space in a relationship in accordance with said size, and for simultaneously controlling a current input to a compressor of said second refrigeration circuit providing a point humidity in a relationship in accordance with said input, said size of said first chamber and said current input to said compressor of said first refrigeration circuit continuously maintaining a point temperature of a temperature setting for said space, said size of said second chamber and said current input to said compressor of said second refrigeration circuit continuously maintaining a point humidity of a humidity setting for said space.

15. An apparatus of claim 14 comprising means for breaking a circuit connecting said compressor of said first refrigeration circuit to any appropriate power supply upon a predetermined deviation beyond a said current input to said compressor operating in a relationship to said point temperature of said temperature setting, means providing wherein said broken circuit is reset automatically to said power supply upon alleviation of said deviation, means for breaking a circuit connecting said compressor of said second refrigeration circuit to any appropriate power supply upon a predetermined deviation beyond said current input to said compressor operating in a relationship to the said point humidity of said humidity setting, means providing wherein said broken circuit is reset automatically to said power supply upon alleviation of said deviation.

16. An apparatus of claim 14 comprising means for varying and regulating a first quantity of said medium under high pressure with a second quantity of said medium under low pressure thereby providing a resulting said medium pressure.

17. An apparatus of claim 14 comprising an oscillator and voltage detection means connected to a meter calibrated in measurements of temperature, humidity, in a relationship in accordance with the adjustment of a size of a gap of a reactor means having an adjustable air gap, means for adjusting a degree of said current input in a linear relationship in accordance with a point of said measurements of said temperature and of said humidity of said space.

18. An apparatus of claim 14 comprising wherein a first of a plurality of gearing means automatically varying and regulating an output of said first, and said second, refrigeration circuit in a linear relationship in accordance with a varying and regulating: of said point temperature of said point temperature setting, of said point humidity of said humidity setting, and comprising wherein a second of said plurality of gearing means providing a said output of each of said refrigeration circuits that is varied and regulated in a linear relationship to each other.

19. An apparatus of claim 14 wherein said first refrigeration circuit normally cycling after a temperature of a space conditioned by said refrigeration circuit becomes equal to the point temperature of a temperature setting, said apparatus providing means for the elimination of said cycling, and wherein said second refrigeration circuit normally cycling after a humidity of a space conditioned by said output device becomes equal to the point humidity of a humidity setting, said apparatus providing means for the elimination of said cycling.

20. An apparatus of claim 14 comprising wherein said compressor of said first refrigeration circuit, and said compressor of said second refrigeration circuit requiring divergent said current input for operation is controlled by a single circuit breaker.

21. An apparatus of claim 14 comprising wherein said first refrigeration circuit producing said point humidity of said humidity setting for said space without a drying coil.

22. An apparatus of claim 14 comprising wherein said first and said second output devices requiring dirvergent said current input is controlled by a single circuit breaker.

23. An apparatus of claim 14 comprising means for independently controlling said current input to said compressor of said first refrigeration circuit and said medium pressure of said first refrigeration circuit such that said controlling of said input and said pressure continuously maintaining said point temperature of said space equal to said point temperature of said temperature setting, and for independently controlling said current input to said compressor of said first refrigeration circuit and said medium pressure of said first refrigeration circuit such that said controlling of said input and said pressure continuously maintaining said point humidity of said space equal to said point humidity of said humidity setting.

24. An apparatus of claim 14 comprising means for manually varying and regulating a degree of said pressure and a degree of said current input in a relationship in accordance with a degree of said temperature, humidity shown on a dial.

25. A control apparatus comprising means for controlling a size of a first variable chamber such that said chamber controls a pressure of a medium of a first output device producing a point temperature of a space in a relationship in accordance with said size, said first output device comprising any one the following: a first refrigeration circuit, a gas heating system, a steam heating system, and for controlling a current input to a second output device providing a point temperature of a space in a relationship in accordance with said input, said second output device comprising any one of the following: a compressor of a second refrigeration circuit, an oil burner pump motor, a motor of a motorized coal system, a conducting element of a hydronic boiler, a conducting element of an electric heating system, and for controlling a size of a second variable chamber such that said chamber controls a pressure of a medium of a third output device producing a point humidity of a space in a relationship in accordance with said size, said third output device comprising a third refrigeration circuit, and for controlling a current input to a fourth output device providing a point humidity of a space in a relationship in accordance with said input, said fourth output device comprising a compressor of a fourth refrigeration circuit, and for controlling a current input to a fan motor providing a point air velocity in a relationship in accordance with said current input, first scanning means for scanning temperature responsive means thereby determining whether or not said size of said first chamber and said current input to said second output device is to be increased or decreased such that said increase or decrease providing a temperature of said space that is maintained equal to the point temperature of a temperature setting, and wherein said medium pressure and said current input is increased or decreased in accordance with said determination, a first plurality of magnetic switching means, a first of said plurality of magnetic means activating and deactivating a first winding of a motor, a second of said plurality of magnetic switching means activating and deactivating a second winding of said motor, said magnetic switching means is controlled by a first magnet moving in and out of the magnetic influence of said magnetic switching means, such that said motor is activated when said temperature is not equal to the point temperature of said temperature setting, second scanning means for scanning humidity responsive means thereby determining whether or not said size of said second chamber controlling said medium pressure of said third output device and said current input to said fourth output device is to be increased or decreased such that said increase or decrease providing a humidity said space that is maintained equal to the point humidity said humidity setting, and wherein said pressure and said current is increased or decreased in accordance with said determination, a second plurality of magnetic switching means, a first of said plurality of magnetic switching means activating and deactivating a first winding of said motor, a second of said plurality of magnetic switching means activating and deactivating said second winding of said motor, said magnetic switching means is controlled by a second magnet moving in and out of the magnetic influence of said magnetic switching means such that said motor is activated when said humidity of said space is not equal to the point humidity of said humidity setting, third scanning means for scanning air velocity responsive means thereby determining whether or not said current input to said fan motor is to be increased or decreased such that said increase or decrease providing an air velocity of a space that is maintained equal to a point air velocity of an air velocity setting, and wherein said current input is increased or decreased in accordance with said determination, said air velocity is defined as the magnitude of the flow of said air from said fan to said air velocity responsive means, a third plurality of magnetic switching means, a first of said plurality of magnetic switching means activating and deactivating a first winding of said motor, a second of said plurality of magnetic switching means activating and deactivating a second winding of said motor, said magnetic switching means is controlled by a third magnet moving in and out of the magnetic influence of said magnetic switching means such that said motor controlling said current input is activated when said air velocity is not equal to the point air velocity of said air velocity setting.

26. An apparatus of claim 25 comprising means for breaking a circuit connecting said first and said second output device to any appropriate power supply upon a predetermined deviation beyond a said current input to said first and said second output device operating in a relationship to said point temperature of said temperature setting, means providing wherein said broken circuit is reset automatically to said power supply upon alleviation of said deviation, means for breaking a circuit connecting said third and said fourth output device to any appropriate power supply upon a predetermined deviation beyond said current input to said third and said fourth output device operating in a relationship to the said point humidity of said humidity setting, means providing wherein said broken circuit is reset automatically to said power supply upon alleviation of said deviation, means for breaking a circuit of said fan motor connected to any appropriate power supply upon a predetermined deviation beyond a current input to said fan motor operating in a relationship to the said point air velocity of said air velocity setting, means providing wherein said broken circuit is reset automatically to said power supply upon alleviation of said deviation.

27. An apparatus of claim 25 comprising means for varying and regulating a first quantity of said medium under high pressure with a second quantity of said medium under low pressure thereby providing a resulting said medium pressure.

28. An apparatus of claim 25 comprising an oscillator and voltage detection means connected to a meter calibrated in measurements of temperature, humidity, and air velocity in a relationship in accordance with the adjustment of a size of a gap of a reactor means having an adjustable air gap, means for adjusting a degree of said current input in a linear relationship in accordance with a point of said measurements of said temperature and of a point of said measurements of said humidity and of a point of said measurements of said air velocity.

29. An apparatus of claim 25 comprising wherein a first of a plurality of gearing means automatically varying and regulating an output of said first output device and an output of said second output device and an output of said third output device in a linear relationship in accordance with a varying and regulating: of a point temperature of said point temperature setting, of a point humidity of said humidity setting, of a point air velocity of said air velocity setting, and comprising wherein a second of said plurality of gearing means providing a said output of each of said output devices that is varied and regulated in a linear relationship to each other.

30. An apparatus of claim 25 wherein said first and second output device normally cycling after a temperature of a space conditioned by said output device becomes equal to the point temperature of a temperature setting, said apparatus providing means for the elimination of said cycling, and wherein said third and said fourth output device normally cycling after a humidity of a space conditioned by said output device becomes equal to the point humidity of a humidity setting, said apparatus providing means for the elimination of said cycling.

31. An apparatus of claim 25 comprising means providing wherein said motor controlling the said size of said first variable chamber and controlling the said current input to said second output device such that said first and said second output device providing a maintaining of said point humidity of a space equal to a point humidity of a humidity setting for said space without modification of any operating component of said first and said second output device.

32. An apparatus of claim 25 comprising wherein said first, second, third and fourth output devices and said fan motor requiring divergent said current input for operation are controlled by a single circuit breaker.

33. An apparatus of claim 25 comprising wherein said first refrigeration circuit providing said maintaining of said point humidity of said humidity setting for said space without a drying coil.

34. An apparatus of claim 25 comprising means for manually varying and regulating a degree of said pressure and a degree of said current input in a relationship in accordance with a degree of said temperature, humidity and air velocity shown on a dial.

35. An apparatus of claim 25 wherein said first refrigeration circuit operates in any one of the following: a first air conditioner, a first heat pump, a first geosolar heat pump system, and wherein said second refrigeration circuit operates in any one of the following: a second air conditioner, a second heat pump, a second geosolar heat pump system, and wherein said third refrigeration circuit operates in any one of the following: a third air conditioner, a third heat pump, a third geosolar heat pump system, a first dehumidifier, and wherein said fourth refrigeration circuit operates in any one of the following: a fourth air conditioner, a fourth heat pump, a fourth geosolar heat pump system, a second dehumidifier.

36. An apparatus of claim 25 comprising wherein said motor also controls a size of a third variable chamber, said size controlling a quantity of heated and cooled air delivered to a space in a relationship in accordance with said size, means for controlling said size such that said size providing a point temperature of said temperature setting.

37. An apparatus of claim 25 comprising wherein said motor also controls a size of a third variable chamber, said size controlling a quantity of humidified air delivered to a space in a relationship in accordance with said size, means for controlling said size such that said size providing a point humidity of said humidity setting.

* * * * *